US011341947B2

(12) United States Patent
Yan et al.

(10) Patent No.: US 11,341,947 B2
(45) Date of Patent: May 24, 2022

(54) SYSTEM AND METHOD FOR MUSICAL PERFORMANCE

(71) Applicant: SUNLAND INFORMATION TECHNOLOGY CO., LTD., Shanghai (CN)

(72) Inventors: Bin Yan, Shanghai (CN); Gang Tong, Shanghai (CN); Xiaoqun Gu, Shanghai (CN)

(73) Assignee: SUNLAND INFORMATION TECHNOLOGY CO., LTD., Shanghai (CN)

( * ) Notice: Subject to any disclaimer, the term of this patent is extended or adjusted under 35 U.S.C. 154(b) by 17 days.

(21) Appl. No.: 16/382,371

(22) Filed: Apr. 12, 2019

(65) Prior Publication Data

US 2019/0237048 A1 Aug. 1, 2019

Related U.S. Application Data

(63) Continuation of application No. PCT/CN2017/070425, filed on Jan. 6, 2017, which is (Continued)

(51) Int. Cl.

*G10H 1/36* (2006.01)
*G10F 1/02* (2006.01)

(Continued)

(52) U.S. Cl.

CPC ..... *G10H 1/368* (2013.01); *G10F 1/02* (2013.01); *G10G 3/04* (2013.01); *G10H 1/0008* (2013.01);

(Continued)

(58) Field of Classification Search

CPC .... G10H 1/368; G10H 1/0008; G10H 1/0066; G10H 2210/031; G10H 2220/091;

(Continued)

(56) References Cited

U.S. PATENT DOCUMENTS 5,265,248 A 11/1993 Moulios et al.
5,315,060 A * 5/1994 Paroutaud ..... G10F 1/00 84/11

(Continued)

FOREIGN PATENT DOCUMENTS

CN 1591563 A 3/2005
JP 2009265631 A 11/2009
JP 4529226 B2 8/2010

OTHER PUBLICATIONS

International Search Report in PCT/CN2017/070425 dated Jul. 17, 2017, 4 Pages.

(Continued)

*Primary Examiner* — Paul Kim
(74) *Attorney, Agent, or Firm* — Metis IP LLC

(57) ABSTRACT

Systems and methods for musical performance are provided. In some embodiments, a system for musical performance includes a processing device to: receive performance information related to a first performance of a piece of music on a first musical instrument; generate at least one control signal based on the performance information; and produce a second performance based on the control signal, wherein to produce the second performance, the processing device is further to: control at least one tone generating device of a second musical instrument to perform the music using the control signal.

18 Claims, 9 Drawing Sheets

Related U.S. Application Data a continuation-in-part of application No. PCT/CN2016/102165, filed on Oct. 14, 2016.

(51) Int. Cl.

| | |
|---|---|
| ***G10G 3/04*** | (2006.01) |
| ***G10H 1/00*** | (2006.01) |
| *G10F 1/18* | (2006.01) |
| *G10F 1/20* | (2006.01) |

(52) U.S. Cl.

CPC ..... *G10H 1/0066* (2013.01); *G10F 1/18* (2013.01); *G10F 1/20* (2013.01); *G10H 2210/031* (2013.01); *G10H 2220/091* (2013.01); *G10H 2240/311* (2013.01); *G10H 2240/325* (2013.01)

(58) Field of Classification Search

CPC ..... G10H 2240/325; G10H 1/0025; G10H 2240/311; G10H 1/36–368; G10C 5/10; G10G 3/04; G10F 1/02; G10F 1/18; G10F 1/20

USPC ..... 700/94

See application file for complete search history.

(56) References Cited

U.S. PATENT DOCUMENTS

| | | | | |
|---|---|---|---|---|
| 5,391,828 | A * | 2/1995 | Tajima | G10H 1/0016 84/464 R |
| 5,530,859 | A | 6/1996 | Tobias, II et al. | |
| 5,569,869 | A | 10/1996 | Sone | |
| 6,069,310 | A * | 5/2000 | James | G10H 1/0058 84/622 |
| 6,078,005 | A | 6/2000 | Kurakake et al. | |
| 6,143,973 | A | 11/2000 | Kikuchi | |
| 6,949,705 | B2 | 9/2005 | Furukawa | |
| 7,512,886 | B1 | 3/2009 | Herberger et al. | |
| 7,589,274 | B2 | 9/2009 | Funaki | |
| 2002/0168176 | A1 | 11/2002 | Iizuka et al. | |
| 2003/0035357 | A1 | 2/2003 | Ishii et al. | |
| 2003/0177886 | A1* | 9/2003 | Koseki | G10H 1/0008 84/600 |
| 2005/0005761 | A1* | 1/2005 | Knudsen | G09B 15/08 84/645 |
| 2005/0150362 | A1* | 7/2005 | Uehara | G10H 1/0066 84/645 |
| 2006/0130640 | A1 | 6/2006 | Fujiwara | |
| 2006/0196346 | A1* | 9/2006 | Ohba | G10F 1/02 84/616 |
| 2006/0227245 | A1 | 10/2006 | Poimboeuf et al. | |
| 2007/0051228 | A1 | 3/2007 | Weir et al. | |
| 2008/0019667 | A1 | 1/2008 | Uehara | |
| 2008/0168470 | A1 | 7/2008 | Bushell et al. | |
| 2008/0168892 | A1 | 7/2008 | Uehara | |
| 2008/0202322 | A1 | 8/2008 | Ishii | |
| 2009/0084248 | A1 | 4/2009 | Furukawa et al. | |
| 2012/0086855 | A1 | 4/2012 | Xu et al. | |
| 2013/0125727 | A1* | 5/2013 | Taylor | G10F 1/02 84/21 |
| 2014/0020543 | A1 | 1/2014 | Oba et al. | |
| 2014/0196593 | A1* | 7/2014 | Langberg | G10D 3/00 84/723 |
| 2016/0379514 | A1* | 12/2016 | Matahira | G09B 15/00 84/470 R |
| 2017/0084261 | A1* | 3/2017 | Watanabe | G10H 1/40 |
| 2018/0183870 | A1* | 6/2018 | Suyama | H04N 21/4307 |

OTHER PUBLICATIONS

Written Opinion in PCT/CN2017/070425 dated Jul. 17, 2017, 4 Pages.

International Search Report in PCT/CN2016/102165 dated Jul. 21, 2017, 4 Pages.

Written Opinion in PCT/CN2016/102165 dated Jul. 21, 2017, 5 Pages.

First Office Action in Chinese Application No. 201680087905.4 dated Aug. 19, 2020, 16 pages.

* cited by examiner

SYSTEM AND METHOD FOR MUSICAL PERFORMANCE

CROSS REFERENCE TO RELATED APPLICATIONS

This application is a continuation of International Application No. PCT/CN2017/070425, filed on Jan. 6, 2017, which in turn claims priority to International Application No. PCT/CN2016/102165, entitled "METHODS AND SYSTEMS FOR SYNCHRONIZING MIDI FILE WITH EXTERNAL INFORMATION," filed on Oct. 14, 2016, the entire contents of each of which are hereby incorporated by reference.

TECHNICAL FIELD

The present disclosure relates to systems and methods for musical performance, and more particularly, to systems and methods for performing music cooperatively using multiple musical instruments.

BACKGROUND

Musical instruments, such as piano, violin, and guitar, are widely played around the world. Conventional approaches for teaching and practicing musical instruments may not provide a musician with a satisfactory experience. For example, the conventional approaches for teaching a musical instrument may rely on classroom teaching methods. A student may find it difficult to learn to play a musical instrument using the classroom teaching methods. As another example, the conventional approaches for practicing musical instruments may not provide mechanisms for facilitating musical performances using multiple musical instruments. Accordingly, it is desirable to provide new mechanisms for musical performance.

SUMMARY

Systems and methods for musical performance are provided. In some embodiments, a system for musical performance includes a processing device to: receive performance information related to a first performance of a piece of music on a first musical instrument; generate at least one control signal based on the performance information; and produce a second performance based on the control signal, wherein to produce the second performance, the processing device is further to: control at least one tone generating device of a second musical instrument to perform the music using the control signal.

In some embodiments, the second musical instrument is a piano, and wherein the tone generating device comprises an actuator.

In some embodiments, to produce the second performance, the processing device is further to actuate a plurality of keys of the second musical instrument based on the control signal.

In some embodiments, the processing device is further to present media content related to the first performance in synchronization with the second performance.

In some embodiments, the second performance is a reproduction of the first performance.

In some embodiments, the first performance corresponds to a first portion of the music, and wherein the second performance corresponds to a second portion of the music.

In some embodiments, the performance information comprises motion information about at least one component of the first musical instrument during the first performance.

In some embodiments, to produce the second performance, the processing device is to: generate the control signal based on the motion information; and cause the tone generating device to perform the music based on the motion information.

In some embodiments, the first musical instrument is a piano, and wherein the motion information comprises information about motions of a plurality of keys of the first musical instrument during the first performance.

In some embodiments, the performance information comprises at least one of an operation sequence of the plurality of keys, timing information about depression of at least one of the plurality of keys, positional information about the plurality of keys, or a musical note produced by at least one of the plurality of keys.

In some embodiments, the performance information is received via a Bluetooth™ link.

In some embodiments, a system for musical performance includes a processing device to: obtain motion information about at least one component of a first musical instrument during a first performance of a piece of music; obtain media content about the first performance; generate performance information about the first performance based on the motion information and the media content; and transmit the performance information to at least one second musical instrument.

In some embodiments, a method for musical performance includes receiving performance information related to a first performance of a piece of music on a first musical instrument; generating at least one control signal based on the performance information; and producing, by a processing device, a second performance based on the control signal, wherein producing the second performance further comprises: controlling at least one tone generating device of a second musical instrument to perform the music using the control signal.

In some embodiments, a method for musical performance includes obtaining motion information about at least one component of a first musical instrument during a first performance of a piece of music; obtaining media content about the first performance; generating, by a processing device, performance information about the first performance based on the motion information and the media content; and transmitting the performance information to at least one second musical instrument.

BRIEF DESCRIPTION OF THE DRAWINGS

The foregoing and other aspects of embodiments of this application are made more evident in the following detail description, when read in conjunction with the attached drawing figures, wherein.

DETAILED DESCRIPTION

The following description is presented to enable any person skilled in the art to make and use the disclosure, and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but is to be accorded the widest scope consistent with the claims.

It will be understood that when a module or unit is referred to as being "on," "connected to" or "coupled to" another module or unit, it may be directly on, connected or coupled to the other module or unit or intervening module or unit may be present. In contrast, when a module or unit is referred to as being "directly on," "directly connected to" or "directly coupled to" another module or unit, there may be no intervening module or unit present. As used herein, the term "and/or" includes any and all combinations of one or more of the associated listed items.

The terminology used herein is for the purpose of describing particular example embodiments only and is not intended to be limiting. As used herein, the singular forms "a," "an" and "the" may be intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 1:
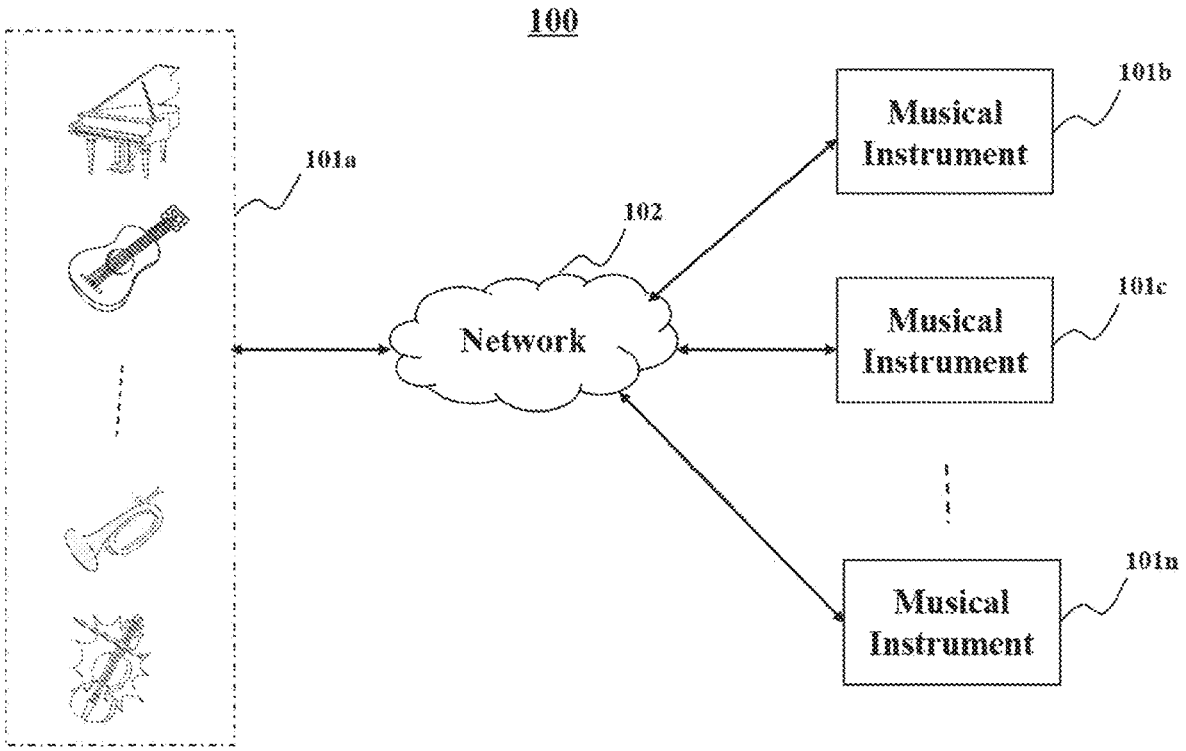
FIG. 1 is a block diagram illustrating an example of a system in which implementations of the disclosure may operate.

FIG. 1 is a block diagram illustrating an example 100 of a system in which implementations of the disclosure may operate. As illustrated in FIG. 1, system 100 may include one or more musical instruments (e.g., musical instruments 101*a*, 101*b*, . . . , 101*n*) and a network 102. System 100 can include any suitable number of musical instruments to implement functionality according to various embodiments of the present disclosure. The musical instruments 101*a*-101*n* may or may not be positioned at the same location.

Each of musical instruments 101*a*-101*n* can be and/or include any musical instrument that can produce musical sounds. For example, each musical instrument 101*a*-101*n* can be and/or include one or more keyboard instruments, such as a piano. The piano may be an acoustic piano, an electric piano, an electronic piano, a digital piano, and/or any other musical instrument with a keyboard. Examples of an acoustic piano that may be used in connection with some embodiments of the present disclosure include a grand piano, an upright piano, a square piano, a specialized piano (such as a toy piano, a mini piano, a prepared piano, etc.), etc. As another example, each musical instrument 101*a*-101*n* may be and/or include one or more wind instruments, such as trumpet, trombones, euphoniums, oboes, saxophones, bassoons, etc. As a further example, each musical instrument 101*a*-101*n* may be and/or include one or more string instruments, such as guitar, violin, autoharp, cimbalom, etc. As a further example, each musical instrument 101*a*-101*n* may be and/or include one or more percussion instruments, such as timpani, snare drum, bass drum, cymbals, tambourine, etc.

Each of musical instruments 101*a*-101*n* can include and/or be communicatively coupled to one or more computing devices, such as a desktop computer, a laptop computer, a tablet computer, a mobile phone, a wearable device (e.g., eyeglasses, head-mounted displays, a wristband, etc.), a server, etc. In some embodiments, a musical instrument can be integrated with one or more computing devices. For example, a tablet computer may be integrated with a piano to perform one or more functions of the piano system, such as displaying music score, indicating one or more piano keys to be depressed during a performance, facilitating communication with one or more other users (e.g., a teacher) through video calls, etc. Alternatively or additionally, each of the musical instruments and the computing devices can be implemented as a stand-alone device. In some embodiments, each of musical instruments 101*a*-101*n* can include one or more devices and/or modules described in connection with FIGS. 2-5 below.

In some embodiments, each of musical instruments 101*a*-101*n* can acquire, process, transmit, receive, and/or perform any other operation on performance information about performances by a user. As referred to herein, performance information related to a performance of a musical instrument may include any information about the performance. For example, the performance information may include any information about the musical instrument, such as a type of the musical instrument (e.g., a piano, a violin, etc.), a model of the musical instrument, a manufacturer of the musical instrument, etc. As another example, the performance information may be and/or include any suitable media content about the performance, such as video content related to the performance, audio content related to the performance, graphics, text, images, and/or any other content related to the performance. As still another example, the performance information can include information about operations of piano keys and/or pedals by a performer during the performance (e.g., an operation sequence of keys and/or pedals, an amount of force applied to one or more keys and/or pedals, a time instant corresponding to depression and/or release of one or more keys and/or pedals, the duration to keep the keys and/or pedals pressed, etc.), etc. As a further example, the performance information can include any suitable information about the music played during the performance (also referred to herein as the "musical data"), such as a musical sheet, a musical score, annotations, musical notes, note duration, note values, a title of the music, operation sequences of keys and/or pedals, a strength to be applied to one or more keys and/or pedals, endurance of and/or any other information about the music.

Network 102 may be configured to connect a musical instrument with one or more other musical instruments. A musical instrument may communicate with one or more other musical instruments (e.g., by transmitting information and/or data to and/or receiving information and/or data from other musical instruments) via a network 102. Network 102 may include a public network (e.g., the Internet), a private network (e.g., a local area network (LAN) or wide area network (WAN)), a wired network (e.g., Ethernet network), a wireless network (e.g., an 802.11 network or a Wi-Fi network), a cellular network (e.g., a Long Term Evolution (LTE) network), routers, hubs, switches, server computers, and/or a combination thereof. In some embodiments, a musical instrument may be communicatively coupled to one or more other musical instruments via one or more communication links. The communication links can be and/or include, for example, one or more network links, dial-up links, wireless links, Bluetooth™ links, hard-wired links, infrared links, any other suitable communication links, or a combination of such links.

In some embodiments, a musical instrument may serve as a master instrument and can control one or more other musical instruments and/or devices (also referred to as "slave instrument(s)") to perform various functions described in the present disclosure. For example, the master instrument can control one or more slave instruments to perform a piece of music (e.g., a piano piece). More particularly, for example, the master instrument can acquire performance information related to a performance of the music by a user (also referred to herein as the "first performance"). The performance information may include, for example, video content related to the performance, audio content related to the first performance, information about operations of piano keys and/or pedals by the user during the first performance, etc. The master instrument can transmit the performance information and/or any other data to one or more slave instruments. Upon receiving the performance information and/or data, the slave instrument(s) can produce a performance of the piece of music (also referred to herein as the "second performance") based on the performance information and/or data. For example, the slave instrument(s) can reproduce the first performance using one or more tone generating devices, such as one or more actuators, keys, strings, hammers, synthesizers, etc. More particularly, for example, the slave instrument(s) can generate one or more control signals to control one or more automatic performance mechanisms to produce the second performance using one or more tone generating devices. As another example, the slave instrument(s) can present media content related to the first performance. More particularly, for example, the slave instrument(s) can provide playback of video content and/or audio content related to the first performance based on the performance information. The video content and/or the audio content may be recorded by the master instrument and may be transmitted to the slave instrument(s) in a real-time manner or any other manner. In some embodiments, each of the master instrument and the slave instrument(s) can include a piano. The slave instrument(s) can analyze the performance information to extract motion information about operations on the master instrument, such as operation sequences of keys, time instants to press keys and/or to use pedals, the strength to be applied to keys and/or pedals, the duration to keep the keys and/or pedals pressed, etc. The slave instrument(s) can generate one or more control signals based on the extracted motion information to control keys and/or pedals of the slave instrument(s) to be operated to perform the music. In some embodiments, the second performance can be a reproduction of the first performance. In some embodiments, each of musical instruments 101*a*-101*n* can serve as a master instrument and/or a slave instrument.

In some embodiments, multiple musical instruments 101*a*-101*n* can be used to perform music cooperatively. For example, multiple musical instruments may perform a piece of music as a musical ensemble. The music may be any music that can be played by multiple instruments, such as a piano piece (e.g., a piano duet, a piano trio, etc.), a string quartet, a piano concerto, a symphony, a song, etc. The musical instruments may include instruments of the same types (e.g., multiple pianos) and/or instruments of different types (e.g., one or more pianos and violins). Each of the musical instrument can perform one or more portions of the music. Multiple musical instruments may perform the same portion of the music or different portions of the music. For example, a first musical instrument (e.g., a first piano) may perform a first portion of the music (also referred to as the "first performance"). A second musical instrument (e.g., a second piano) can perform a second portion of the music (e.g., also referred to as the "second performance"). The first portion and the second portion may or may not be the same. The first performance may be rendered by one or more tone generating devices of the first musical instrument (e.g., one or more actuators, synthesizers, pedals, keys, etc. of the first piano). The second performance may be rendered by one or more tone generating devices of the second musical instrument (one or more actuators, synthesizers, pedals, keys, etc. of the second piano). In some embodiments, the first performance and/or the second performance can be rendered using one or more automatic performance mechanisms (e.g., one or more actuators of a piano, synthesizers, etc.). Alternatively or additionally, one or more portions of the first performance and/or the second performance can be rendered by one or more performers. In some embodiments, the first musical instrument can generate performance information about the first performance (also referred to as the "first performance information") and can transmit the first performance information to one or more other musical instruments (e.g., the second musical instrument). The second musical instrument can generate performance information about the second performance (also referred to as the "second performance information") and can transmit the second performance information to one or more other musical instruments (e.g., the first musical instrument, a third musical instrument, etc.). In some embodiments, the first performance information and/or the second performance information can be transmitted in a real-time manner.

In some embodiments, a musical instrument may serve as a master instrument and may transmit a music score to one or more slave instruments. Upon receiving the music score, the slave instrument(s) may recognize one or more portions of the music score to be played by the slave instrument(s) and can play the portions of the music. The master instrument and the slave instrument(s) may form a musical ensemble to perform a piece of music based on the same music score. As such, a performer can perform the master instrument and control the slave instruments(s) to render a band performance. As another example, a performer may play a piano quartet using four pianos. More particularly, for example, the performer may play the piano piece three times with different playing skills and record each performance respectively. Then, three different performances of the same piano piece may be transmitted to three pianos. The performer may then play the piano piece for the fourth time, and the three slave pianos may reproduce the received performances at the same time. As such, the performer can perform the piano quartet using multiple musical instruments.

In some embodiments, multiple musical instruments 101*a*-101*n* may be used to perform music. For example, a first musical instrument may perform a piece of music by a performer. The performance scene (also referred to as the "first performance") may be recorded by any suitable media acquisition device (e.g., one or more cameras, camcorders, video recorders, audio recorder, etc.). For example, one or more cameras or holographic cameras may be used to record the first performance scene. The performance scene may include performance images or videos from various fields of view. The performance scene may be included in performance information about the first performance (also referred to as the "first performance information") and may be transmitted to one or more other musical instruments (e.g., the second musical instrument). The second musical instrument may produce a performance of the piece of music (also referred to as the "second performance") based on the first performance information. For example, the second musical instrument may reproduce the first performance using one or more tone generating devices. The second performance may be presented in any suitable manner. For example, the second musical instrument may perform the piece of music using one or more automatic performance mechanisms (e.g., one or more actuators of a piano, synthesizers, etc.) without a performer. As another example, the secodn perforamnce may be presented using one or more virtual reality (VR) devices, augmented reality (AR) devices, mixed reality (MR) devices, head-mounted displays (HMDs), wearable computing devices, holographic devices, three-dimensional displays, etc. In some embodiments, the audiences of a concert may wear VR head-mounted display (HMD) devices (e.g., Oculus Rift, HTC Vive, Sony PlayStation VR, Google Cardboard, Gear VR, etc.), AR head-mounted display (HMD) device (e.g., Google Glass), etc. to consume the performance that a virtual performer is playing the second musical instrument. The virtual performer may be the performer of the first performance that is generated based on the first performance information by VR devices. The virtual performer also may be any other performers whose performance is suitable for the performance of the second musical instrument. For example, the audiences at a live concert may wear AR head-mounted display (HMD) devices (e.g., Google Glass) to consume the performance that a virtual performer is playing a real piano. As another example, the audiences not at the live concert may wear VR head-mounted display (HMD) devices to appreciate the virtual performance that a virtual performer is performing a virtual musical instrument. In some embodiments, the audiences may consume the second performance using one or more holographic devices. The holographic device(s) may project images of the performer of the first performance onto the stage of a concert to present a combination show of virtual images and real musical instruments.

Figure 2:
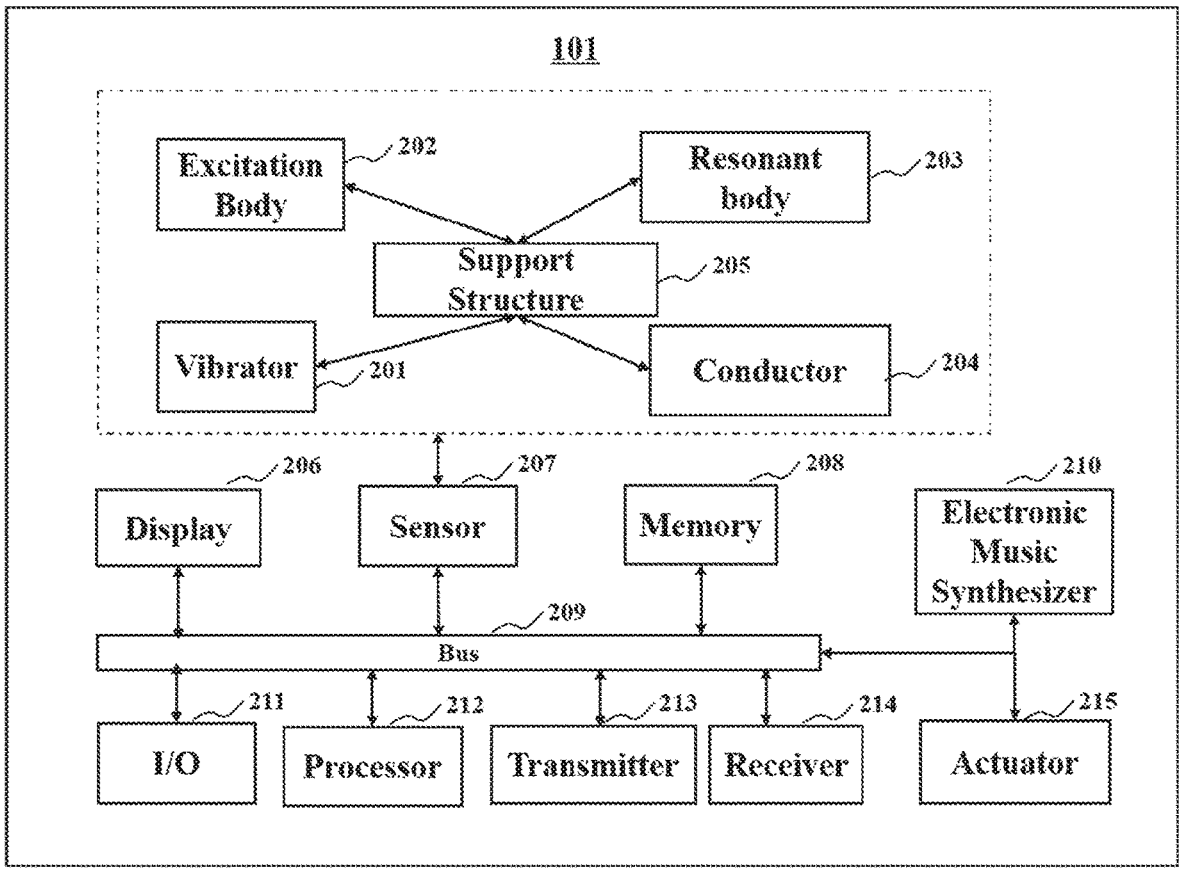
FIG. 2 is a block diagram illustrating an example of a musical instrument according to some embodiments of the present disclosure.

FIG. 2 is a block diagram illustrating an example of a musical instrument according to some embodiments of the present disclosure. As illustrated in FIG. 2, each of musical instruments 101*a*-101*n* may include a vibrator 201, an excitation body 202, a resonant body 203, a conductor 204, a support structure 205, a display 206, one or more sensors 207, a memory 208, a bus 209, an electronic music synthesizer 210, an input/output (I/O) 211, a processor 212, a transmitter 213, a receiver 214, and one or more actuators 215. Vibrator 201, excitation body 202, resonant body 203, conductor 204, and/or support structure 205 may form a tone generating device of the musical instrument. Vibrator 201 may be any device that can produce tone while vibrating, such as strings, clappers, etc. Excitation body 202 may be any device that can excite vibrator 201 to vibrate, such as a violin bow, reed, etc. Resonant body 203 may be any device that can radiate tones, such as a cavity, a sound board, etc. Conductor 204 may be any device that can conduct tones, such as a bridge. Support structure 205 may be any device that can support and/or provide housing for vibrator 201, excitation body 202, resonant body 203, and conductor 204, such as a violin body.

Display 206 may be configured to display information and/or data. In some embodiments, display 206 may display information and/or data according to a user's input via I/O 211. In some embodiments, display 206 may display information and/or data fetched from memory 208. In some embodiments, display 206 may display information and/or data received from receiver 214. Display 206 may be any suitable device capable of receiving, converting, processing, and/or displaying text and media content as well as performing any other suitable functions. For example, display 206 may include a Liquid Crystal Display (LCD) panel, a Light Emitting Diode display (LED), an Organic Light Emitting Diodes (OLED) panel, a cathode ray tube (CRT) display, a plasma display, a touchscreen, a simulated touchscreen, the like, or any combination thereof. In some embodiments, display 206 may be and/or include one or more virtual reality (VR) devices, augmented reality (AR) devices, mix reality (MR) device, head-mounted displays (HMDs), three-dimensional displays, holographic displays, etc. For example, display 206 may be and/or include VR head-mounted display (HMD) device (e.g., Oculus Rift, HTC Vive, Sony PlayStation VR, Google Cardboard, Gear VR, etc.), virtual retinal displays, AR head-mounted display (HMD) devices (e.g., Google Glass), MR device (e.g., Magic leap, Hololens, etc.), and holographic projector display devices, etc. In some embodiments, display 206 may be configured to receive inputs from the user. For example, display 206 may include a touchscreen configured to detect one or more user inputs via touch pressure, touch position, touch input area, touch gestures, the like, or any combination thereof.

Sensor(s) 207 may be configured to detect motion of one or more components of a musical instrument, such as one or more tone generating devices of the musical instrument. Sensor(s) 207 may be or include optoelectric sensor, magneto-electric sensor, angle sensor, piezoelectric sensor, etc. In some embodiments, a musical instrument may be and/or include a piano and sensor(s) 207 may include one or more key sensors and pedal sensors. The key sensors may be placed in proximity to keys (e.g., above the keys, under the keys, etc.) to detect motion information of piano keys. The motion information may include positions of keys, a time instant corresponding to the depression of the key, a time instant corresponding to the release of the key, depression strength, velocities of one or more keys during their motion, a sequence of keys depressed by a user, etc. The pedal sensors may detect motion information of pedal, such as positions of pedal, a time instant corresponding to the depression of the pedal, a time instant corresponding to the release of the pedal, depression strength, velocities of pedal during its motion, the sequence of pedal be depressed, etc.

Memory 208 may be and/or include any hardware device configured to store information and/or data for use in a musical instrument. For example, memory 208 may be and/or include random-access memory (RAM), read-only memory (ROM), programmable read-only memory (PROM), Electrically Erasable Programmable Read-Only Memory (EEPROM), flash memory, hard disk drives, solid-state drives, etc. Memory 208 may receive and store information and/or data relating to applications, programs, instructions, and/or any other information and/or data accessible by other components of the musical instrument. In some embodiments, memory 208 may be a local memory integrated into each of musical instruments 101*a*-101*n*. In some embodiments, memory 208 may be a standalone memory to store all of the information relating to each of musical instruments 101*a*-101*n*. And each of musical instruments 101*a*-101*n* can communicate (e.g. access, copy, store data, etc.) with the independent memory 208.

Bus 209 may be configured to transfer information and/or data between electronic components of the musical instruments. Bus 209 may cover all related hardware components (wire, optical fiber, etc.) and software, including communication protocols. As illustrated in FIG. 2, display 206, sensor(s) 207, memory 208, music synthesizer 210, I/O 211, processor 212, transmitter 213, receiver 214, and actuator(s) 215 may communicate with each other via bus 209.

Electronic music synthesizer 210 may be configured to produce sound by generating electronic signals. Electronic music synthesizer 210 may be included in an electronic musical instrument. In some embodiments, electronic music synthesizer 210 may include a music controller for controlling its sound (e.g., by adjusting the pitch, frequency, and/or duration of each note). Electronic music synthesizer 210 may also include an output device (e.g., a loudspeaker) and a music synthesizer to present audio content. The music controller and the music synthesizer may communicate with each other through a musical performance description language, such as Musical Instrument Digital Interface (MIDI), Open Sound Control, etc.

I/O 211 may be configured to input information and/or data from other device and/or output information and/or data to another device. In some embodiments, I/O 211 may be implemented as a touchscreen to detect input of users. In some embodiments, I/O 211 may be implemented using a voice recognition device to detect the voice of users. In some embodiments, I/O 211 and display 206 may be implemented as a single device or component. In some embodiments, I/O 211 may include a USB interface, a CD driver, an HDMI interface, or other interfaces to input and/or output information and/or data to other devices.

Processor 212 may be configured to execute instructions (program code) stored in memory 208. Computer instructions may include, for example, routines, programs, objects, components, data structures, procedures, engines, modules, units, and/or functions that perform one or more functions (or methods) described herein. Processor 212 may receive information and/or data from sensor(s) 207 and receiver 214. Processor 212 may receive input data via I/O 211 and process it. Processor 212 may output information and/or data to display 206 to be displayed. Processor 212 may generate data and transmit the data to memory 208, transmitter 213, or actuator 215. In some embodiments, processor 212 may transmit information and/or data to music synthesizer 210 to produce electronic music. In some embodiments, processor 212 may process recorded performance scene to produce virtual images that can be watched by VR and/or AR display device or holographic projection onto the stage. Processor 212 may be implemented in any suitable manner including a central processing unit (CPU), an application-specific integrated circuit (ASIC), an application-specific instruction-set processor (ASIP), a graphics processing unit (GPU), a physics processing unit (PPU), a microcontroller unit, a digital signal processor (DSP), a field-programmable gate array (FPGA), an ARM, or the like, or any combination thereof.

Transmitter 213 may be configured to transmit information and/or data to other devices via wired or wireless communication links. Receiver 214 may be configured to receive information and/or data from other devices via wired or wireless communication links. The communication links can be and/or include, for example, network links, dial-up links, wireless links, Bluetooth™ links, hard-wired links, infrared links, any other suitable communication links, or a combination of such links. In some embodiments, transmitter 213 and receiver 214 may be implemented as a single device or component (e.g., a transceiver).

Actuator(s) 215 may be configured to actuate one or more tone generating devices of a musical instrument (e.g., one or more keys of a piano, strings of a guitar, etc.) to perform a piece of music. In some embodiments, a musical instrument may be a piano and actuator(s) 215 may include key actuators and pedal actuators. Key actuators may receive control signal(s) from processor 212 and press the key(s). And pedal actuators also may receive control signal(s) from processor 212 and press the pedal(s). In some embodiments, a musical instrument may be a guitar and actuator(s) 215 may include one or more indicators (e.g., one or more LED lamps) to indicate the positions of strings that a user should strum. In some embodiments, the musical instrument may be a trumpet and actuator(s) 215 may include an earphone to remind a user the moment and duration to play the trumpet.

It should be noted that musical instrument described above is provided for illustration, and not intended to limit the scope of the present disclosure. For persons having ordinary skills in the art, various modifications and variations may be conducted under the teaching of the present disclosure. However, those modifications and variations may not depart from the scope of the present disclosure. In some embodiments, a musical instrument 101*a*-101*n* may also include other components not showed in FIG. 2. For example, a musical instrument 101*a*-101*n* may further include one or more devices to acquire media content related to a performance of a performer. The devices may be and/or include one or more cameras, camcorders, microphones, video recorders, audio recorders, and/or any device that is capable of acquiring media content. In some embodiments, one or more cameras may be used to capture holographic images or videos related to a performance of a performer. In some embodiments, a musical instrument 101*a*-101*n* may include and/or connect to multiple VR devices and/or AR devices that can process performance information to produce virtual images or holographic projection.

It should be noted that a musical instrument 101*a*-101*n* described above does not have to include all the components numbered from 201 to 215. For example, a musical instrument 101*a*-101*n* may be an electronic musical instrument and does not include components vibrator 201, excitation body 202, resonant body 203, and conductor 204. In some embodiments, a musical instrument 101 may be a traditional instrument to produce tone through vibration and does not include electronic music synthesizer 210. In some embodiments, display 206 may be an independent device and may include a transceiver to communicate with other components. In some embodiments, display 206, sensor(s) 207, memory 208, bus 209, I/O 211, processor 212, transmitter 213, receiver 214, and actuator(s) 215 may be combined to form a single device. And this single device may attach or connect to a traditional or an electronic musical instrument.

Figure 3:
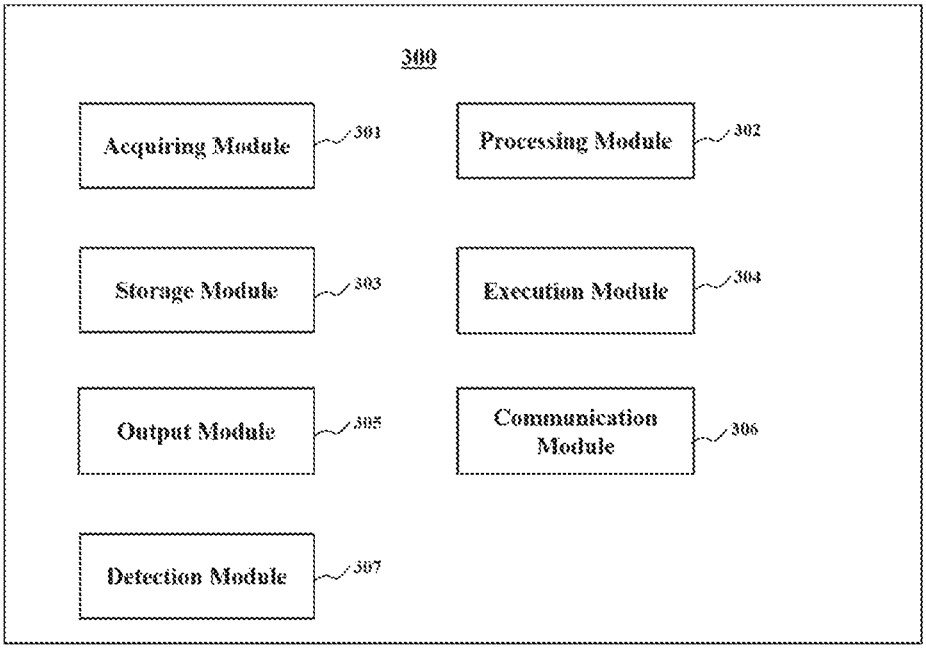
FIG. 3 is a block diagram illustrating an example of a processing device according to some embodiments of the present disclosure.

FIG. 3 is a block diagram illustrating an example 300 of a processing device according to some embodiments of the present disclosure. In some embodiments, one or more processing devices 300 can be included in one or more music instruments described in connection with FIG. 1. Alternatively or additionally, processing device 300 can be implemented as a stand-alone device. In some embodiments, processing device 300 can perform one or more processes 600-900 of FIGS. 6-9 and/or one or more portions of these processes.

As illustrated in FIG. 3, processing device 300 may include an acquiring module 301, a processing module 302, a storage module 303, an execution module 304, an output module 305, a communication module 306, and a detection module 307. More or fewer components may be included in processing device 300 without loss of generality. For example, two of the modules may be combined into a single module, or one of the modules may be divided into two or more modules. In one implementation, one or more of the modules may reside on different computing devices. In some embodiments, one or more modules of the processing device 300 can be implemented using one or more components of a musical instrument as described in connection with FIGS. 1-2. For example, the processing device 300 can be implemented using one or more of display 206, sensor(s) 207, memory 208, I/O 211, processor 212, transmitter 213, receiver 214, actuator 215, electronic music synthesizer 210, etc.

Acquiring module 301 may be configured to acquire information and/or data related to performances of a musical instrument. In some embodiments, acquiring module 301 may receive the first performance information that represents the performance of another musical instrument, via receiver 214. For example, another musical instrument may be a piano and the first performance information may include video content related to the performance, audio content related to the performance, information about operations of piano keys and/or pedals by the user during the performance, MIDI files, etc. Also in some embodiments, acquiring module 301 may acquire the motion information of a performer by sensor(s) 207. For example, a musical instrument may be a piano and sensor(s) 207 may detect the motion of keys and/or pedals. The information detected by sensors may be processed to represent the performance of this piano. In some embodiments, acquiring module 301 may acquire information and/or data from the user via I/O 211. For example, a user may download a piece of music to musical instrument 101 by USB interface. In some embodiments, acquiring module 301 may acquire images and/or videos via one or more cameras. For example, acquiring module 301 may acquire holographic images of a performance by multiple cameras from various fields of view. Acquiring module 301 may transmit the acquired signal to processing module 302 for further processing. Acquiring module 301 may transmit the acquired signal to storage module 303 to be stored.

Processing module 302 may be configured to process information and/or data. The information and/or data may be transmitted from acquiring module 301. The information and/or data also may be acquired from the storage module 303. In some embodiments, processing module 302 may be configured to recognize different formats of information and/or data, such as sensor data or user input via I/O 211. In some embodiments, different musical instruments may form a band to perform instrumental ensemble. Processing module 302 may be configured to analyze music score to extract the part suit for performing by this instrument. In some embodiments, processing module 302 may combine different information and/or data to a combined information and/or data for transmitting and storing. For example, a musical instrument 101*a*-101*n* may include a video recorder to capture and record the performance of a performer and a voice recording device to record the music performed by performer. Processing module 302 may combine the video and audio information and/or data to a combined information and/or data for transmitting. In some embodiments, processing module 302 may convert information and/or data to a uniform data format or a specific data format which can be recognized by one or more other musical instruments (e.g., one or more slave instruments). As another example, a master instrument may be a piano and the slave instruments may be guitar. The processing module 302 may convert the performance information of the piano to a specific format that a guitar may be recognized. In some embodiments, processing module 302 may generate one or more control signals based on performance information transmitted from a master instrument. For example, a slave piano may receive performance information from a master piano. The processing module 302 may generate a control signal to cause one or more keys of the slave piano to be pressed according to timing information related to depression and/or release of keys of the master piano. An amplitude of the key control signal may indicate a strength to be applied to the key(s) of the slave piano (e.g., a strength applied to one or more corresponding keys of the master piano). In some embodiments, different amplitudes of the control signal may correspond to different strengths applied to one or more keys of the master piano during the first performance. As another example, processing module 302 may generate a control signal to control a key to be pressed for a certain duration based on information related to a time period during which one or more keys of the master piano were pressed during the first performance. In some embodiments, processing module 302 may give instruction(s) to execution module 304 to edit MIDI file 1000 corresponding to the video. In some embodiments, processing module 302 may match MIDI file 1000 to video, or synchronizing MIDI file 1000 and video according to instructions of musical instrument 101*a*-101*n*. Merely by way of example, processing module 302 may convert timing information of video into tick information. In some embodiments, processing module 302 may give instruction(s) to execution module 304 to edit MIDI file 1000 based on tick information.

Storage module 303 may be configured to store information and/or data. The information and/or data to be stored in storage module 303 may be information and/or data from acquiring module 301. For example, a slave musical instrument may receive performance information from a master instrument and store it in storage module 303. The information and/or data to be stored may be information and/or data processed by processing module 302. For example, processing module 302 of a slave instrument may separate performance information into different parts, such as motion information, video content related to the performance and audio content related to the performance, then processing module 302 may transmit them to storage module 303 to be stored. Storage module 303 may receive and store information and/or data relating to applications, programs, instructions, and/or any other information and/or data accessible by other modules of processing device 300. In some embodiments, storage module 303 may include a data base to store kinds of the music score, video content related to the performance of famous performer, historical performance data of this musical instrument, etc.

Execution module 304 may be configured to perform one or more operations based on the control signal(s) generated by processing module 302. In some embodiments, a musical instrument 101*a*-101*n* may be a piano and execution module 304 may include one or more key actuators and/or pedal actuators. Execution module 304 may receive one or more control signals generated by processing module 302 and drive the actuators to press the key(s) to perform a music. In some embodiments, a musical instrument 101*a*-101*n* may be a guitar and execution module 304 may include one or more indicators (e.g., one or more LED lamps) to indicate the positions of strings that a user should strum. In some embodiments, a musical instrument 101*a*-101*n* may be a trumpet and execution module 304 may include an earphone to remind a user the moment and duration to play the trumpet. In some embodiments, a musical instrument 101*a*-101*n* may be an electronic musical instrument and execution module 304 may produce electronic tones based on the received performance information. Execution module 304 may be configured to operate MIDI file 1000. MIDI file 1000 operated may be acquired from acquiring module 301. In some embodiments, Execution module 304 may edit tick information of MIDI file 1000. Execution module 304 may identify MIDI file 1000 corresponding to the video. In some embodiments, Execution module 304 may control MIDI file in order to play musical instrument 101*a*-101*n*. In some embodiments, Execution module 304 may play MIDI file, and musical instrument 101*a*-101*n* may perform music accordingly. In some embodiments, acquiring module 301 may acquire data, MIDI file(s), and/or video information stored in storage module 303, and Execution module 304 may generate a modified MIDI file based on acquired data, MIDI file(s), and/or video information.

Output module 305 may be configured to output information and/or data. The information and/or data may include, for example, performance information related to one or more performances, music data related to one or more pieces of music, etc. For example, output module 305 may output media content (e.g., video content, audio content, graphics, text, etc.) related to one or more performances to a display device, a speaker, and/or any other device for presentation. In some embodiments, output module 305 may output the data and/or information to an external storage device, such as a mobile hard disk drive, a USB flash disk, a CD, a cloud-based storage, a server, etc.

Communication module 306 may be configured to facilitate communications between one or more components of processing device 300 and another component of system 100. Communication module 306 may include a transmitter unit and a receiver unit. The transmitter unit and/or receiver unit may transmit and/or receive information and/or data via one or more wired or wireless communication links (e.g., one or more Wi-Fi links, Bluetooth™ links, etc.). For example, a musical instrument may transmit performance information to another musical instrument via Bluetooth™ in proximity (e.g., within a range of a Bluetooth™ link). In some embodiments, communication module 306 may transmit data and/or information via transmitter 213. In some embodiments, communication module 306 may receive performance information and/or data from other musical instrument 101*a*-101*n* or any other device via receiver 214. In some embodiments, communication module 306 may include a single device or unit (e.g., a transceiver) to implement the functionality of receiving and transmitting.

Detection module 307 may be configured to detect information. The information may include MIDI file 1000, video, the performance of musical instrument 101*a*-101*n* or other instruments, or the like, or any combination thereof. In some embodiments, detection module 307 may identify video information. The video information may include timing information of video frame. For example, video frame may include information of pressing a piano key at a moment. In some embodiments, the moment may correspond to the timing information. In some embodiments, execution module 304 may identify MIDI file 1000 corresponding to video based on timing information of video frame detected by detection module 307. In some embodiments, detection module 307 may identify the performance of musical instrument 101*a*-101*n* based on MIDI file 1000. In some embodiments, detection module 307 may identify video corresponding to MIDI file 1000 based on tick information of MIDI file 1000.

Figure 4:
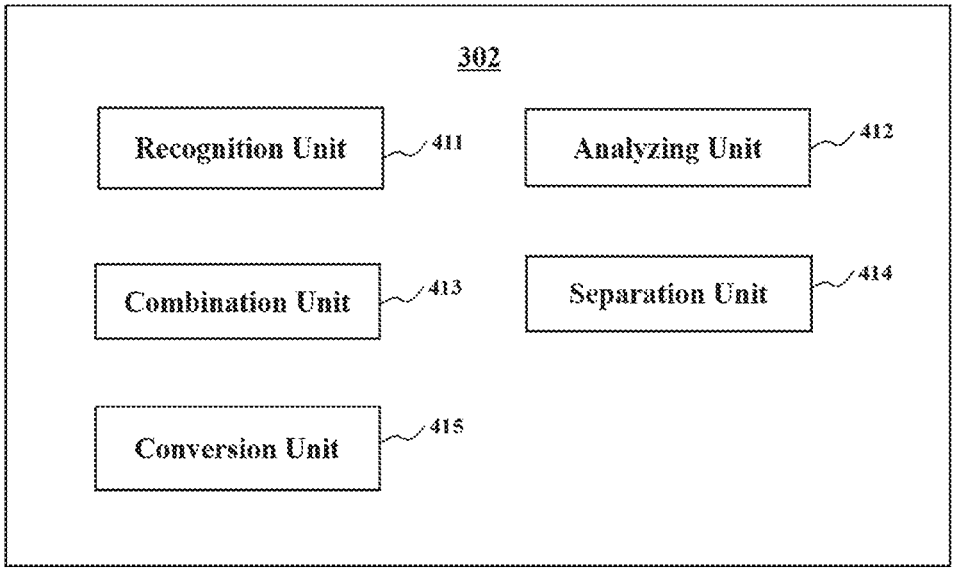
FIG. 4 is a block diagram illustrating an example of a processing module according to some embodiments of the present disclosure.

FIG. 4 is a block diagram illustrating an example of a processing module 302 according to some embodiments of the present disclosure. As illustrated in FIG. 4, processing module 302 may include a recognition unit 411, an analyzing unit 412, a combination unit 413, a separation unit 414, and a conversion unit 415.

Recognition unit 411 may be configured to recognize the type of information and/or data. Different types of information and/or data may be processed by different methods. For example, the sensor data acquired by acquiring module 301 may be used to generate motion information representing operation sequences of keys, pedals, and/or any other component of a musical instrument, time instants and/or durations corresponding to a positon of a key, etc. Recognition unit 411 may recognize different information formats and transmit them to different unit for further processing. For example, performance information received from other devices may be transmitted to analyzing unit 412 first. Recognition unit 411 may be configured to identify timing information. In some embodiments, recognition unit 411 may identify timing information of video. For example, timing information of each video frame may be identified. In some embodiments, recognition unit 411 may further identify MIDI file 1000 matching video frame(s) of the video. For example, recognition unit 411 may identify MIDI file 1000 based on timing information of video.

Analyzing unit 412 may be configured to analyze information and/or data of various types. The data and/or information may be provided by one or more components of system 100. For example, analyzing unit 412 can analyze sensor data provided by one or more sensors 207 and can extract motion information related to one or more components of a musical instrument from the sensor data. Analyzing unit 412 may analyze the motion information and add the motion information to a corresponding proportion of a music score. In some embodiments, a slave instrument may receive performance information from a master instrument, the performance information may include multiple parts, such as motion information, video content related to the performance and audio content related to the performance, music score, ID of the device, etc. Analyzing unit 412 may analyze each part of the performance information respectively. For example, analyzing unit 412 may analyze a music score to extract the part suit for performing by this local slave instrument. Analyzing unit 412 may analyze the motion information and determine motions of one or more keys and pedals. In some embodiments, analyzing unit 412 may generate one or more control signal(s) based on the extracted motion information. In some embodiments, analyzing unit 412 may synchronize video with MIDI file 1000. Merely by way of example, analyzing unit 412 may synchronize video with MIDI file 1000 of user karaoke performance. In some embodiments, analyzing unit 412 may give feedback to MIDI execution module 304. In some embodiments, the feedback may include information regarding whether video and MIDI file 1000 are matched. In some embodiments, MIDI execution module 304 may further edit tick of MIDI file based on the feedback. In some embodiments, analyzing unit 412 may synchronize tick of MIDI file 1000 with tick information converted by conversion unit 415.

Combination unit 413 may be configured to combine different information and/or data into combined information and/or data. In some embodiments, acquiring module 301 may acquire different kinds of information and/or data, such as sensor data from sensor(s) 207, video content related to the performance and audio content related to the performance, music data, etc. Combination unit 413 may generate a combination of the information for subsequent transmission or store. For example, combination unit 413 of a piano may combine the motion information, video content, audio content, a music score, a resume of the performer, the brand of piano, the type of a musical instrument, etc. to generate one or more packets for transmission.

Separation unit 414 may be configured to separate information and/or data. In some embodiments, information and/or data to be processed by processing module 302 may be information and/or data combination from other devices. Contrary to combination unit 413, separation unit 414 may separate them and extract information and/or data suitable for a musical instrument. For example, a slave musical instrument may receive performance information from a master instrument. The separation unit 414 of the slave musical instrument may separate the performance information into motion information, video content, audio content, music score, a resume of the performer, a type of the musical instrument, etc.

Conversion unit 415 may be configured to convert the format of information and/or data. In some embodiments, a master instrument may transmit information and/or data to slave instrument(s), conversion unit 415 may convert information and/or data to a uniform format that can be recognized by any slave instrument. For example, a piano may serve as a master instrument and the slave instruments may include guitar, violin, trumpet, etc. The information transmitted among these instruments may be uniform format information so that each instrument may recognize the information. In some embodiments, the master instrument may receive an ID information and/or data from slave instrument(s), and the ID information and/or data may include data format that the slave instrument may recognize. Conversion unit 415 may convert information and/or data to the specified format of the slave instrument. For example, a master piano may receive format information from a slave violin. The format information may represent the format that the slave violin may receive. So the conversion unit 415 of the master piano may convert the performance information into the specified format that the slave violin can recognize. Conversion unit 415 may be configured to convert timing information. In some embodiments, conversion unit 415 may convert timing information into tick information. For example, conversion unit 415 may convert timing information based on a mathematical model. In some embodiments, recognition unit 411 may identify tick of MIDI file 1000 based on tick information converted by conversion unit 415.

In some embodiments, processing module 302 does not have to include all the units described above. For example, a master instrument does not include separation unit 414 and a slave instrument does not include combination unit 413. In some embodiments, two or more units may be combined into a single module, or one of the modules may be divided into two or more modules. For example, conversion unit 415 may be combined with analyzing unit 412 to implement functions described in the present disclosure.

Figure 5:
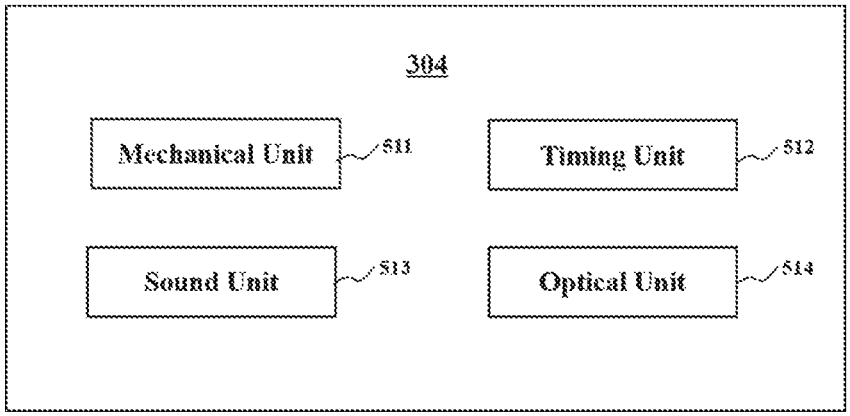
FIG. 5 is a block diagram illustrating an example of an execution module according to some embodiments of the present disclosure.

FIG. 5 is a block diagram illustrating an example of an execution module 304 according to some embodiments of the present disclosure. As illustrated in FIG. 5, execution module 304 may include a mechanical unit 511, a timing unit 512, a sound unit 513, and an optical unit 514. Mechanical unit 511 may be configured to execute one or more operations based on the control signal(s) that processing module 302 generated. In some embodiments, a musical instrument may be a piano and mechanical unit 511 may be and/or include one or more key actuators and pedal actuators. The control signal(s) may include one or more signals to control one or more keys and/or pedals to be pressed and/or released. For example, mechanical unit 511 may drive the key actuators to press and/or release the key(s) to produce tone based on the key pressing signal and/or the key releasing signal. As another example, mechanical unit 511 may drive the pedal actuators to press or release the pedals according to the pedal pressing signal or the pedal releasing signal. In some embodiments, mechanical unit 511 may include a solenoid-operated unit.

Timing unit 512 may be configured to perform timing control and coordinate with other components to implement various functions of system 100. For example, timing unit 512 can cause one or more keys, pedals, and/or any other component of a musical instrument to be pressed and/or released at a particular time instant, for a particular time period, etc.

Sound unit 513 may be configured to generate sounds. In some embodiments, sound unit 513 may be an earphone or any other output device. In some embodiments, sound unit 513 may play audio content that received from another musical instrument (e.g., a master instrument).

Optical unit 514 may be configured to indicate positions. In some embodiments, a musical instrument may be a guitar, and optical unit 514 may include one or more indicators (e.g. one or more LED lamps) to indicate the positions of strings that a user should strum. In some embodiments, a musical instrument may be a piano, and optical unit 514 may include one or more indicators (e.g. one or more LED lamps) above the keys to indicate which key the user should press.

In some embodiments, execution module 304 does not have to include all the units described above. For example, musical instruments like guitar or violin, in some cases, may need a participation of a performer to perform a piece of music. The mechanical unit 511 may be omitted in these musical instruments. In some embodiments, two or more units may be implemented as a single unit or one of the units may be divided into two or more units. For example, mechanical unit 511 or optical unit 514 may include a timing unit to control time respectively.

Figure 6:
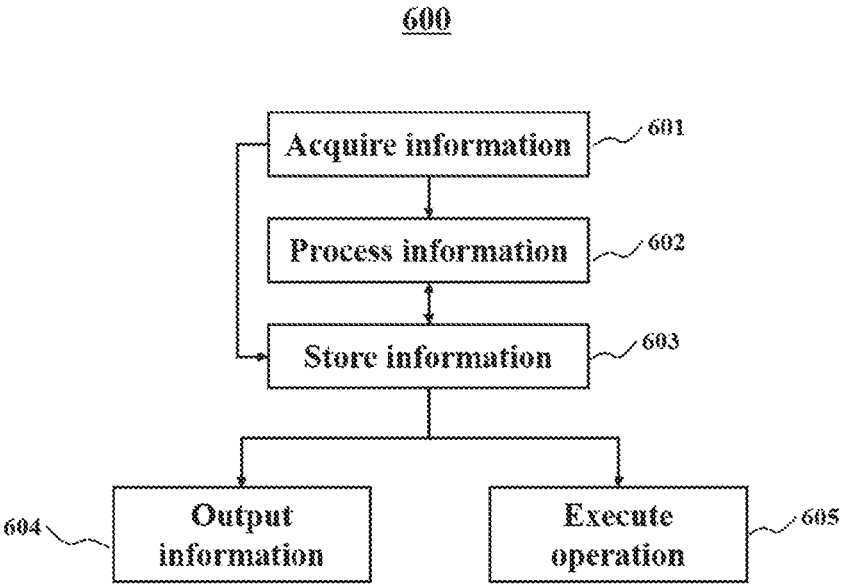
FIG. 6 is a flowchart illustrating an exemplary process for musical performance according to some embodiments of the present disclosure.

FIG. 6 is a flowchart illustrating an exemplary process for musical performance according to some embodiments of the present disclosure. Process 600 may be performed by processing logic that may comprise hardware (e.g., circuitry, dedicated logic, programmable logic, microcode, etc.), software (such as instructions run on a processing device), firmware, or a combination thereof. Process 600 may be performed by a musical instrument (e.g., a musical instrument as described in connection with FIGS. 1-5).

As illustrated in FIG. 6, at step 601, acquiring module 301 may acquire information. For example, the acquired information may be and/or include sensor data obtained by one or more sensors configured to monitor one or more components of the musical instrument (e.g., one or more sensor(s) 207). The sensor data may include motion information about motions of one or more components of the musical instrument, such as positional information of the component(s) during a performance, timing information related to motions of the component(s) during the performance, etc. For example, the musical instrument may be a piano. The motion information may include information related to one or more keys depressed during a performance of a piece of music on the musical instrument, such as positional information of the key(s), a time instant corresponding to depression of the key(s), a time instant corresponding to release of the key(s), depression strength, velocities of one or more keys during their motion, a sequence of keys depressed by a user, etc. As another example, the motion information may relate to one or more pedals operated during a performance of a piece of music on the musical instrument, such as positional information of the pedal(s), a time instant corresponding to depression of the pedal(s), a time instant corresponding to release of the pedal(s), depression strength, velocities of pedal(s) during its motion, a sequence of pedals operated during the first performance, etc. In some embodiments, the acquired information may be and/or include any suitable media content about a performance of a piece of music on the master instrument, such as video content related to the performance, audio content related to the performance, graphics, text, images, holographic images, and/or any other content related to the performance. In some embodiments, the acquired information may include media content related to one or more performances performed on the musical instrument.

In some embodiments, the acquired information may be and/or include performance information transmitted from one or more other musical instruments. The performance information may include any information about one or more performances on the other musical instrument(s). For example, the performance information may include any suitable media content about the performance(s), such as video content related to the performance(s), audio content related to the performance(s), graphics, text, images, and/or any other content related to the performance. As another example, the performance information may include information about one or more components of the other musical instrument(s) during the performance(s), such as operations of piano keys and/or pedals by a user during a performance on the other musical instrument(s). As a further example, the performance information can include any suitable information about the music played during the performance(s), such as a musical sheet, a musical score, annotations, musical notes, note durations, note values, a title of the music, operation sequences of keys and/or pedals, a strength to be applied to one or more keys and/or pedals, and/or any other information about the music.

In some embodiments, at step 601, acquiring module 301 may acquire information in any suitable manner. For example, acquiring module 301 may send, to one or more other musical instruments, one or more requests for the information. The information may then be received via one or more responses corresponding to the requests. In some embodiments, acquiring module 301 may include a receiver that can receive information from other devices. As another example, acquiring module 301 can include one or more sensors (e.g., one or more sensors 207, cameras, microphones, etc.) configured to detect the information.

At step 602, processing module 302 may process the information. For example, the information may be processed by performing one or more operations described in conjunction with FIGS. 7-15 below.

At step 603, the acquired information may be stored. For example, storage module 303 may store the acquired information in one or more storage devices (e.g., memory 208, a cloud-based storage, a server, etc.). The stored information be used for further processing, transmission, etc.

At step 604, output module 305 may output information. For example, output module 305 may output video content related to the performance to a display for presentation. In some embodiments, the display device can be integrated with the musical instrument. Alternatively or additionally, the display device can be a stand-alone device. The display device may include any suitable display to display any suitable content. For example, the display device can be display 206 of FIG. 2. In some embodiments, output module 305 may provide playback of audio content via an earphone, a loudspeaker, or any other device that is capable of presenting audio content. In some embodiments, media content related to a first performance can be presented in synchronization with another performance (e.g., a reproduction of the first performance). For example, media content corresponding to a particular portion of the music can be presented while the portion of the music is performed by one or more components of the musical instrument. In some embodiments, output module 305 may output video content related to the performance and/or audio content related to the performance to an external storage device, such as a mobile hard disk drive, a USB flash disk, a CD, a cloud-based storage, a server, etc.

As another example, performance information and/or any other information related to a performance may be transmitted to one or more other musical instruments. The performance information may be transmitted via one or more communication links, such as one or more network links, dial-up links, wireless links, Bluetooth™ links, hard-wired links, infrared links, any other suitable communication links, or a combination of such links.

At step 605, execution module 304 may execute one or more operations. For example, the musical instrument can produce a performance using one or more components of the musical instrument. The components of the musical instrument may include one or more tone generating devices, such as one or more actuators, hammers, keys, pedals, synthesizers, and/or any other component of the musical instrument that can be used to produce music sounds. In some embodiments, the performance may be a reproduction of another performance (e.g., a performance produced by another musical instrument). In some embodiments, the performance and/or one or more other performances may form a band performance. The performance may be produced using one or more automatic performance mechanisms (e.g., one or more actuators of a piano).

Figure 7:
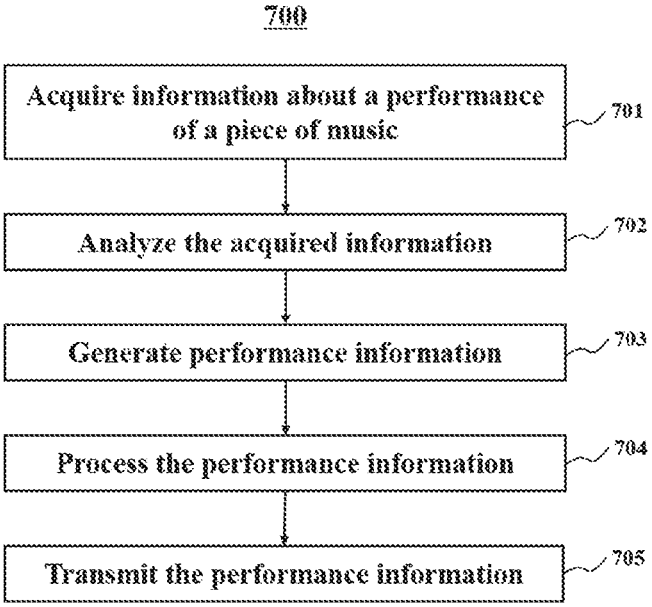
FIG. 7 is a flowchart illustrating an exemplary process for generating performance information according to some embodiments of the present disclosure.

FIG. 7 is a flowchart illustrating an exemplary process 700 for generating performance information according to some embodiments of the present disclosure. Process 700 may be performed by processing logic that may comprise hardware (e.g., circuitry, dedicated logic, programmable logic, microcode, etc.), software (such as instructions run on a processing device), firmware, or a combination thereof. In one embodiment, process 700 can be performed by one or more musical instruments as described in connection with FIGS. 1-5.

At step 701, a processing device may acquire information about a performance of a piece of music. The information may be acquired by performing one or more operations described in connection with step 601 of FIG. 6. The performance may be played by a user on a musical instrument. In some embodiments, one or more portions of the performance may be produced by one or more automatic performance mechanisms implemented by the music instrument.

The obtained information may include any suitable information about the performance. For example, the information may include motion information about one or more components of the musical instrument (e.g., one or more keys, pedals, etc.) during the performance. As another example, the information may include media content related to the performance. As still another example, the information may include musical data related to the music.

At step 702, the processing device may analyze the acquired information. For example, the processing device can analyze the acquired information to associate the motion information with one or more corresponding proportions of the music data. More particularly, for example, the processing device can identify one or more musical notes and/or any other music data corresponding to the particular motion of one or more components of the musical instrument (e.g., depression and/or release of one or more key(s) to produce the notes). The processing device may also associate motion information about the particular motion with the identified musical notes and/or other musical data related to the identified musical notes. For example, the motion information about the particular motion may be stored in association with musical data related to the identified notes. In some embodiments, the processing device can associate the media content with the motion information and/or the musical data. For example, the processing device can identify a portion of the media content corresponding to a performance of a portion of the music. The processing device can then associate the portion of the media content with musical data associated with the portion of the music (e.g., a portion of a music sheet) and/or motion information related to the portion of the music (e.g., motions of one or more components of the music instrument for performing the portion of the music).

As another example, the processing device can generate one or more control signals based on the acquired information. The control signal(s) may be used to cause one or more components of a musical instrument to perform the music. For example, the control signals may include timing information about actuation of one or more components of a musical instrument, such as a time instant corresponding to depression of one or more keys of a piano, a time instant corresponding to release of the key(s), a duration of the depression, a note duration produced by pressing the key(s), etc. The control signal(s) may also include information about a force to be used to operate the component(s) of the musical instrument. As another example, the control signal(s) may include information that can be used to control an electronic music synthesizer to perform one or more portions of the music. The control signal(s) may include any information that can be used to provide playback of video content, audio content, and/or any other media content.

At step 703, the processing device may generate performance information based on the acquired information and/or the analysis. For example, the processing device can combine various types of information related to the performance, such as motion information (e.g. information about motions of a plurality of keys and/or pedals of the master instrument during the performance), the media content related to the performance (e.g., video content, audio content, etc.), the musical data (e.g., a music score, etc.), a resume of the performer, the brand of the musical instrument, the type of the musical instrument (e.g., a piano), associations between different types of information (e.g., associations between the motion information and the musical data and/or the media content), etc. In some embodiments, the performance information may be generated by performing one or more operations described in connection with FIGS. 10-15 below.

At step 704, the processing device may process the performance information for transmission. For example, conversion unit 415 may convert the performance information into one or more specific formats, such as one or more data formats that can be processed by one or more other musical instruments and/or processing devices. As another example, the processing device can compress data about the performance information. More particularly, for example, the compression may be performed using one or more video codecs, audio codecs, and/or any other device that can perform data compression.

As a further example, the processing device can generate one or more units of data according to one or more communication protocols to transmit the performance information. Each of the units of data can include, for example, a packet, a bit stream, etc. Examples of the communication protocols can include BLUETOOTH, the Hypertext Transfer Protocol (HTTP), the Transport Control Protocol/Internet Protocol (TCP/IP), NetBios Enhanced User Interface (NetBEUI), Internetwork Packet Exchange/Sequences Packet Exchange (IPX/SPX), etc.

At step 705, the processing device can transmit the performance information. The performance information may be transmitted to one or more other musical instruments. The performance information can be transmitted via any suitable communication link. In some embodiments, the performance information can be transmitted in real-time. Alternatively or additionally, the performance information can be recorded for transmission at a later time.

Figure 8:
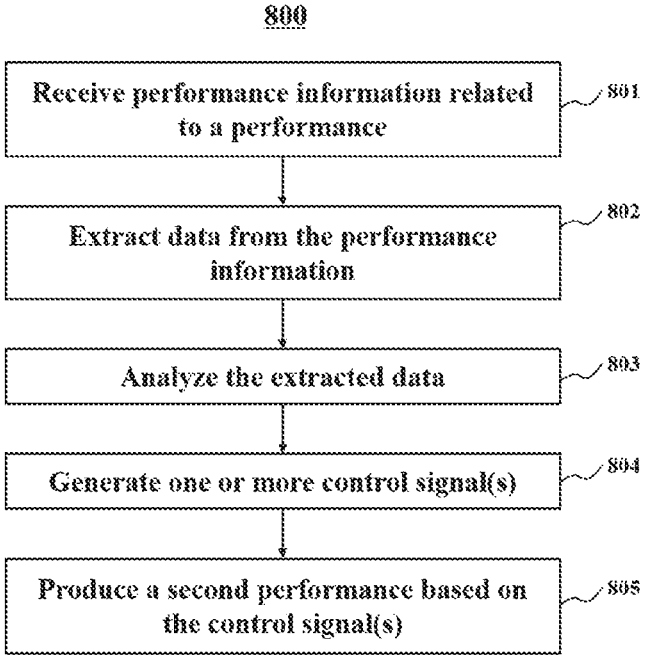
FIG. 8 is a flowchart illustrating an exemplary process for processing performance information according to some embodiments of the present disclosure.

FIG. 8 is a flowchart illustrating an exemplary process 800 for processing performance information according to some embodiments of the present disclosure. Process 800 may be performed by processing logic that may comprise hardware (e.g., circuitry, dedicated logic, programmable logic, microcode, etc.), software (such as instructions run on a processing device), firmware, or a combination thereof. In one embodiment, process 800 can be performed by one or more musical instruments as described in connection with FIGS. 1-5.

At step 801, a processing device can receive performance information related to a performance. The performance information may be generated by performing one or more operations described in connection with FIGS. 6-7 above. In some embodiments, the performance information may include information about a first performance of a piece of music on a first musical instrument.

At step 802, the processing device may extract data from the performance information. For example, the processing device can parse data units containing the performance information and can extract one or more portions of the performance information. More particularly, for example, the processing device can extract, from the performance information, one or more of motion information, musical data, media content related to the music, associations between the motion information and/or the musical data and/or the media content, etc.

At step 803, the processing device may analyze the extracted data. For example, the processing device may analyze the extracted musical data to generate a music score to be played by a second musical instrument (also referred to as the "second music score"). In some embodiments, the second music score may be a music score that was played during the first performance (also referred to as the "first music score"). In some embodiments, the second music score may be different from the first music score. For example, the first music and the second music score may correspond to a first portion of the music (e.g., a first part of a piano piece) and a second portion of the music (e.g., a second part of a piano piece), respectively.

As another example, the processing device may analyze the motion information. In some embodiments, the processing device can associate the motion information with one or more corresponding proportions of the extracted data. More particularly, for example, the processing device can identify one or more musical notes and/or any other music data corresponding to particular motion of one or more components of the first musical instrument (e.g., depression and/or release of one or more key(s) to produce the notes). The processing device may also associate motion information about the particular motion with the identified musical notes and/or other musical data related to the identified musical notes. For example, the motion information about the particular motion may be stored in association with musical data related to the identified notes. In some embodiments, the processing device can associate the media content with the motion information and/or the musical data. For example, the processing device can identify a portion of the media content corresponding to a performance of a portion of the music. The processing device can then associate the portion of the media content with musical data associated with the portion of the music (e.g., a portion of a music sheet) and/or motion information related to the portion of the music (e.g., motions of one or more components of the music instrument for performing the portion of the music).

As still another example, the processing device can decode data about the performance information using one or more decoding methods. More particularly, for example, encoded media content (e.g., encoded video content, encoded audio content, etc.) can be decoded and/or processed for presentation.

At step 804, the processing device may generate one or more control signals. The control signal(s) may be generated based on the received performance information. The control signal(s) may be used to control one or more components of the second musical instrument to produce a second performance. For example, one or more tone generating devices of the musical instrument can be actuated to produce the second performance based on the control signals. In some embodiments, the second performance may be a reproduction of the first performance. For example, one or more components of a second musical instrument can be operated to reproduce the movement of one or more components a first musical instrument during the first performance. In a more particular example, the processing device can determine a component of the first musical instrument (also referred to as the "first component") and one or more time instants corresponding to depression and/or release of the first component during the first performance based on the motion information. The processing device can then generate a control signal to cause a component of the second musical instrument (also referred to as the "second component") to be operated based on the identified time instants. The second component of the second musical instrument may correspond to the first component of the first musical instrument. For example, the first component (e.g., a first piano key) and the second component (e.g., a second piano key) may be used to produce the same musical tone. The second piano can also identify an amount of a force applied to the first component and can determine a force to be used to actuate the second component accordingly.

In some embodiments, the first performance and the second performance can correspond to different portions of the music. For example, the first performance and the second performance may correspond to a first portion of the music (e.g., a first part of a piano duet) and a second portion of the music (e.g., a second part of a piano duet), respectively. The processing device can generate one or more control signals to cause one or more components of the second musical instrument to perform the second portion of the music. The control signals may include, for example, one or more signals to actuate the component(s) to play the music score of the second portion of the music (e.g., the second music score).

As another example, the processing device can generate one or more control signals to control an electronic music synthesizer to perform one or more portions of the music. As still another example, the processing device may generate one or more control signals to control one or more components of the second musical instrument to present media content related to the first performance. The control signal(s) may include any information that can be used to provide playback of video content, audio content, and/or any other media content. The control signal(s) can be used to present media content related to the first performance in synchronization with the second performance.

At step 805, the processing device can produce a second performance based on the control signals. For example, one or more components (e.g., tone generating devices) of the second musical instrument can be actuated based on the control signals. As another example, media content related to the first performance can be presented based on the control signals. For example, one or more VR devices, AR devices, etc. may be used to present the second performance in a suitable manner. In some embodiments, the second performance may be produced by performing one or more operations described in connection with FIGS. 10-15 below.

Figure 9:
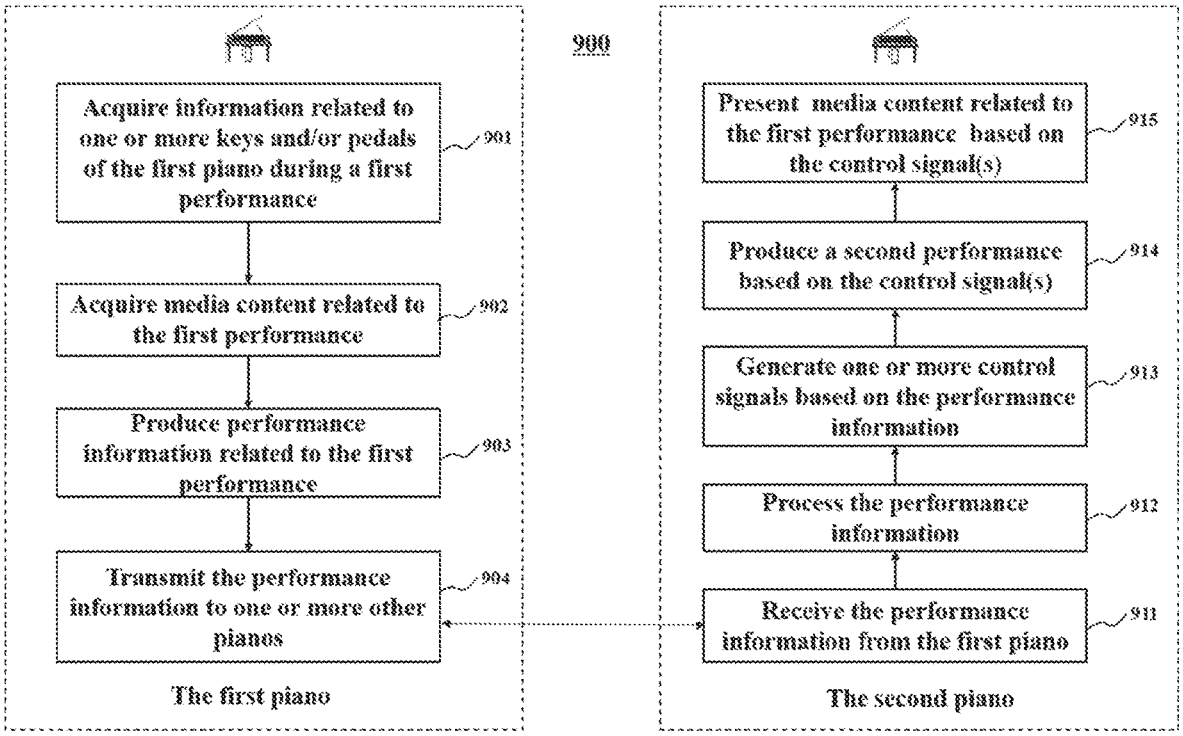
FIG. 9 is flowchart illustrating an exemplary process for musical performance using multiple musical instruments according to some embodiments of the present disclosure.

FIG. 9 is a flowchart illustrating an exemplary process 900 for musical performance using multiple instruments according to some embodiments of the present disclosure. Process 900 may be performed by processing logic that may comprise hardware (e.g., circuitry, dedicated logic, programmable logic, microcode, etc.), software (such as instructions run on a processing device), firmware, or a combination thereof. In one embodiment, process 900 can be performed by one or more musical instruments as described in connection with FIGS. 1-5. For example, as illustrated in FIG. 9, process 900 may be performed by a first piano and one or more second pianos. The first piano may serve as a master instrument. Each of the second pianos may serve as a slave instrument. The first piano and the second piano(s) may communicate with each other. The second piano(s) may reproduce performances of the first piano.

Steps 901 to 904 may be implemented by the first piano. At step 901, the first piano may acquire information related to one or more keys and/or pedals of the first piano during a first performance. The first performance may be a performance of a piece of music by one or more performers on the first piano. The acquired information may include any information about one or more keys and/or pedals operated during the first performance. For example, the acquired information may include motion information related to one or more keys depressed during the first performance, such as positional information of the key(s), a time instant corresponding to depression of the key(s), a time instant corresponding to release of the key(s), depression strength, velocities of one or more keys during their motion, a sequence of keys depressed by a user, etc. As another example, the acquired information may include motion information of one or more pedals operated during the first performance, such as positional information of the pedal(s), a time instant corresponding to depression of the pedal(s), a time instant corresponding to release of the pedal(s), depression strength, velocities of pedal(s) during its motion, a sequence of pedals operated during the first performance, etc. In some embodiments, the information related to the key(s) and/or the pedal(s) may be acquired using one or more sensors (e.g., one or more sensors 207 of FIG. 2) that can detect motion information and/or any other information related to keys and/or pedals of a piano.

In some embodiments, the first piano may process the motion information based on musical data about the music (e.g., a music score, one or more notes to be played, etc.). For example, the first piano can identify one or more musical notes and/or any other music data corresponding to the particular motion of one or more keys and/or pedals (e.g., depression and/or release of the key(s) to produce the notes). The first piano may also associate motion information about the particular motion with the identified musical notes and/or other musical data related to the identified musical notes. For example, the motion information about the particular motion may be stored in association with musical data related to the identified notes.

At step 902, the first piano may acquire media content related to the first performance. For example, the first piano can acquire audio content, video content, images, graphics, and/or any other content related to the first performance. In some embodiments, the first piano may acquire and/or record video content and/or audio content of the first performance using one or more cameras, camcorders, microphones, and/or any other device that is capable of acquiring media content. For example, one or more video recorders may be used to capture video content related to the first performance from various fields of view to get a full picture of the first performance. As another example, one or more cameras may be incorporated into a wearable device to record the performance from the performer's perspective. Still as another example, one or more holographic cameras may be used to record holographic images of the first performance. In some embodiments, the media content can be stored in one or more storage devices.

At step 903, the first piano may produce performance information related to the first performance. The performance information may be produced based on the information related to the keys and/or pedals, the media content, and/or any other information related to the first performance. The performance information may include any information related to the first performance, such as motion information related to one or more keys and/or pedals, video content, audio content, information about the performer (e.g., the name of the performer, a resume of the performer), information about the first piano (e.g., the brand of the first piano, the type of the first piano, etc.), etc. In some embodiments, the performance information may also include musical data related to the music played during the first performance, such as a musical sheet, a musical score, annotations, musical notes, note values, a title of the music, operation sequences of keys and/or pedals, a strength to be applied to one or more keys and/or pedals, and/or any other information about the music.

In some embodiments, the first piano can process the performance information for transmission. For example, the first piano can generate one or more units of data according to one or more communication protocols to transmit the performance information. Each of the units of data can include, for example, a packet, a bit stream, etc. Examples of the communication protocols can include BLUETOOTH, the Hypertext Transfer Protocol (HTTP), the Transport Control Protocol/Internet Protocol (TCP/IP), NetBios Enhanced User Interface (NetBEUI), Internetwork Packet Exchange/Sequences Packet Exchange (IPX/SPX), etc.

As another example, the first piano may convert the performance information into one or more specific formats. In some embodiments, the first piano and one or more second pianos may be different types of piano and the information can be recognized by each piano may be different. The first piano may convert the performance information into one or more specific formats that each of the second pianos can recognize. For example, each of the second pianos may transmit information about the format requirement to the first piano after communication was established between the first piano and each of the second pianos. Then the first piano may convert the performance information into one or more specific formats based on the format requirements of each of the second pianos. As another example, the first piano may convert the performance information based on the information about the second piano(s) (e.g., the type of the second piano, the brand of the second piano, the communication interface of the second piano). In some embodiments, the first piano and one or more second pianos may be electronic pianos and the performance information may be converted into the MIDI format. In some embodiments, the first piano can compress data about the performance information to generate compressed data (e.g., encoded video data, encoded audio data, etc.).

At step 904, the first piano may transmit the performance information to one or more other pianos. For example, the performance information can be transmitted to the second piano. The performance information may be transmitted using one or more communication links. The communication links may include one or more network links, dial-up links, wireless links, Bluetooth™ links, hard-wired links, infrared links, any other suitable communication links, or a combination of such links. In some embodiments, the first piano may generate the performance information and transmit the performance information to the second piano in real-time. In some embodiments, the first piano may record data about the first performance and may transmit the data to one or more other pianos at a later time. In some embodiments, the performance information can be transmitted according to Real-Time Transport Protocol (RTP), Real-Time Transport Control Protocol (RTCP), Real Time Streaming Protocol (RTSP), Microsoft Media Server Protocol (MMS), a Bluetooth™ protocol, etc.

Steps 911 to 915 may be implemented by one or more other pianos. For example, steps 911 to 915 may be implemented by a second piano to produce a second performance. The second performance may be a performance of the piece of music that was performed by the first piano. For example, the second performance may be a reproduction of the first performance by the second piano. At step 911, the second piano may receive the performance information from the first piano. For example, the second piano can receive the performance information by receiving one or more bitstreams, data packets, messages, and/or any other data unit that contain the performance information.

At step 912, the second piano may process the received performance information. For example, the second piano can parse the performance information. In some embodiments, different portions of the performance information may be used by different modules or units of the second piano to perform different operations. The second piano may parse the performance information based on positional information (e.g., header information of the packets), time information (e.g., timestamps of the packets), etc. As another example, the second piano may extract one or more portions of the performance information. More particularly, for example, the second piano can extract one or more of the motion information, the musical data, the media content related to the music, etc. from the performance information. As still another example, the second piano can decode data about the performance information using one or more decoding methods. More particularly, for example, encoded media content (e.g., encoded video content, encoded audio content, etc.) can be decoded and/or processed for presentation. In some embodiments, the second piano may process the information related to performance scene of the first performance to produce one or more virtual images or videos of the performer during the first performance.

At step 913, the second piano may generate one or more control signals based on the performance information. The control signal(s) may be used to control one or more components of the second piano to produce the second performance (e.g., a reproduction of the first performance). For example, the second piano can generate one or more control signals based on the performance information to control one or more actuators to actuate one or more keys and/or pedals of the second piano. More particularly, for example, the keys and/or pedals of the second piano can be operated to reproduce movements of keys and/or pedals of the first piano during the first performance. In some embodiments, the control signals may be generated based on the motion information extracted from the performance information. For example, the second piano can determine a key of the first piano (also referred to as the "first key") and one or more time instants corresponding to depression and/or release of the key during the first performance based on the motion information. The second piano can then generate a control signal to cause a key of the second piano (also referred to as the "second key") to be depressed and/or released based on the identified time instants. The second key of the second piano may correspond to the first key of the first piano. The second piano can also identify a strength (e.g., an amount of force) applied to the first key and can determine a force to be used to actuate the second key based on the identified strength. The control signal(s) may also include information about the force to be applied to the second key. As such, movements of the second key during the second performance may represent movements of the first key during the first performance. In some embodiments, one or more control signals can be generated to actuate multiple keys of the second piano to perform one or more portions of the music.

As another example, the second piano can generate one or more control signals to control an electronic music synthesizer to perform one or more portions of the music.

As still another example, the second piano can generate one or more control signals to control one or more components of the second piano to present media content related to the first performance. The control signal(s) may include any information that can be used to provide playback of video content, audio content, and/or any other media content. For example, the control signal(s) may include decoded audio data, decoded video data, presentation timestamps related to the decoded audio data and/or video data, etc. Various types of media content related to the first performance can be presented synchronously. In some embodiments, the control signal(s) may be used to synchronize presentation of the media content and reproduction of the first performance by the second piano. For example, the control signal(s) may be used to control media content corresponding to a particular portion of the music to be presented while the portion of the music is performed by one or more components of the second piano. In some embodiments, the control signal(s) may be used to produce virtual images of one or more performers to be presented while a piece of music is performer by the second piano.

In some embodiments, one or more of the control signals can be generated by the first piano and can be transmitted to the second piano.

At step 914, the second piano may produce the second performance based on the control signal(s). For example, the second piano can cause one or more actuators and/or any other component to press keys and/or pedals according to the control signal(s). As another example, the second piano can cause one or more electronic music synthesizers to perform one or more portions of the music according to the control signal(s). As still another example, the second piano may cause VR and/or AR components or device to produce virtual images or videos of the performer of the first performance according to one or more control signals.

At step 915, the second piano may present media content related to the first performance based on the control signal (s). For example, the second piano may present video content related to the first performance on a display device. In some embodiments, the display device can be integrated with the second piano. Alternatively or additionally, the display device can be a stand-alone device. The display device may include any suitable display to display any suitable content. For example, the display device can be display 206 of FIG. 2. The video display may display one or more videos about the piece of music. The music score display may provide one or more music scores to identify a preceding musical note and a subsequent musical note. As another example, the second piano may present audio content related to the first performance using one or more audio output devices, such as an earphone, a speaker, etc. In some embodiments, the media content can be presented in synchronization with the second performance based on one or more of the control signals. For example, media content corresponding to a particular portion of the music can be presented while the portion of the music is performed by one or more components of the second piano. In some embodiments, the second piano may present virtual images of a performer on VR or AR head-mounted display (HMD) device (e.g., Oculus Rift, HTC Vive, Sony PlayStation VR, Google Cardboard, Gear VR, Google Glass) worn by audiences in synchronization with the piano performance. For example, the audiences at the live concert may wear AR glass to appreciate the performance that a virtual performer is playing a real piano. The virtual performer may be the performer of the first performance or any other performers whose performance is suitable for the performance of the second piano. As another example, the audiences not at the live concert may wear VR HMD device to appreciate the virtual performance. In some embodiments, the second piano may project holographic images of the performers in the first performance onto a stage to reproduce the virtual first performance.

In some embodiments, the first piano and the second piano(s) may be used for piano teaching and/or practicing. For example, the first piano may be played by a teacher. The first performance may be a performance of the teacher. One or more second pianos may reproduce the performance of the teacher to give students a close look at the performance of the teacher.

Figure 10:
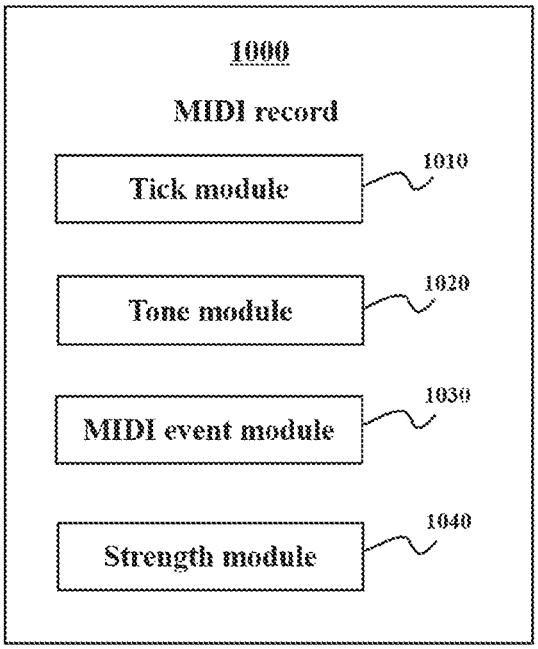
FIG. 10 is a block diagram illustrating an exemplary MIDI file according to some embodiments of the present disclosure.

FIG. 10 is a block diagram illustrating an exemplary MIDI file according to some embodiments of the present disclosure. MIDI file 1000 may include one or more MIDI records. In some embodiments, a MIDI record may include a tick module 1010, a tone module 1020, a MIDI event module 1030, and a strength module 1040.

Tick module 1010 may include a plurality of data representing tick information. Tick information may be related to the timing information of one or more MIDI events. In some embodiments, processor 212 may match tick information of MIDI file 1000. In some embodiments, processor 212 may synchronize MIDI file 1000 and video based on tick information. In some embodiments, processor 212 may convert tick information based on timing information of video. In some embodiments, processor 212 may execute MIDI file 1000 and induce musical instrument 101*a*-101*n* to perform music. In some embodiments, MIDI file 1000 may be executed based on tick information of tick module 1010.

Tone module 1020 may include a plurality of data representing tone information. In some embodiments, tone information may include different kinds (e.g., 128 kinds) of musical tone of musical instrument 101*a*-101*n*. In some embodiments, musical instrument 101*a*-101*n* may play musical tone based on tone information. In some embodiments, processor 212 may control musical tone of musical instrument 101*a*-101*n* based on tick information, and/or tone information in MIDI file 1000. For example, processor 212 may control the on/off state of 128 kinds of musical tone according to tick information of tick module 1010. As another example, processor 212 may determine which key(s) of musical instrument 101*a*-101*n* may be pressed based on tone information of tone module 1020.

MIDI event module 1030 may include a plurality of data representing event information. Event information may relate to one or more motion instructions. In some embodiments, MIDI event module 1030 may include a motion instruction of keyboard, pedal, or the like, or any combination thereof. The motion instruction may refer to pressing or rebounding a key, pedal, or the like, or any combination thereof. In some embodiments, MIDI event module 1030 may relate to tone module 1020. For example, tone module 1020 may instruct which musical tone may be played, and MIDI event module 1030 may instruct a motion of keyboard, and/or pedal to realize playing the musical tone.

Strength module 1040 may include a plurality of data representing strength information. Strength information may indicate the pressing strength of keyboard and/or pedal of musical instrument 101*a*-101*n*. In some embodiments, processor 212 may control the pressing strength based on strength information. In some embodiments, processor 212 may define the pressing strength based on strength module 1040. For example, processor 212 may control tension of keyboard within music instrument 101*a*-101*n* based on strength module 1040. Musical instrument 101*a*-101*n* may apply the pressing strength to keyboard and/or pedal through applying a certain current to the pressing control device within musical instrument 101*a*-101*n*. In some embodiments, the current may have a certain magnitude, and/or frequency.

Figure 11:
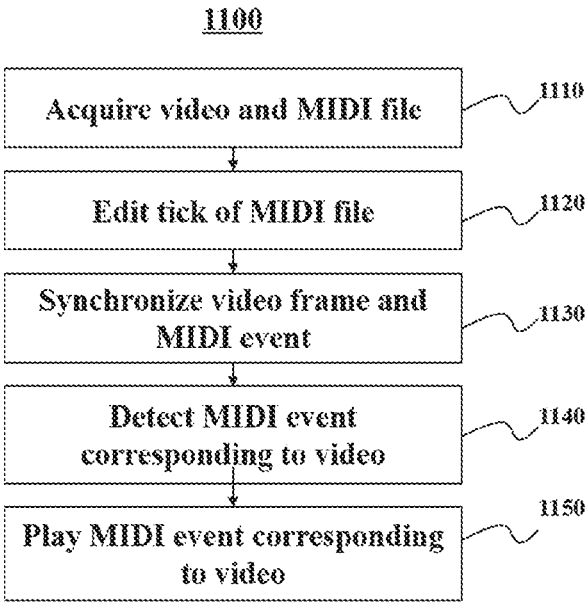
FIG. 11 is a flowchart illustrating an exemplary process for synchronizing MIDI files with video according to some embodiments of the present disclosure.

FIG. 11 is a flowchart illustrating an exemplary process for synchronizing MIDI file with video according to some embodiments of the present disclosure. In some embodiments, at 1110, acquiring module 301 may acquire information. In some embodiments, information acquired at 1110 may include data of a video, a MIDI file, an audio file, or the like, or any combination thereof. For example, the video data may include a performance of musical instrument 101*a*-101*n* or other instruments. In some embodiments, acquiring module 301 may acquire video and/or MIDI file 1000 from storage module 303. In some embodiments, acquiring module 301 may record video and MIDI file 1000 that are associated with the same performance through musical instrument 101*a*-101*n* simultaneously, alternately or at a different time. In some embodiments, acquiring module 301 may acquire video from storage module 303, and record MIDI file 1000 through musical instrument 101*a*-101*n*. In some embodiments, acquiring module 301 may acquire MIDI file 1000 from storage module 303, and record video through musical instrument 101*a*-101*n*. In some embodiments, processing module 302 may store the information acquired at 1110 in musical instrument 101*a*-101*n*, processing module 302, and/or storage module 303.

At 1120, execution module 304 may edit MIDI file(s) acquired at 1110. The MIDI file(s) edited at 1120 may include MIDI file 1000. In some embodiments, execution module 304 may edit one or more MIDI records of MIDI file 1000. In some embodiments, execution module 304 may edit tick information, tone information, MIDI event information, and/or strength information of MIDI file 1000. In some embodiments, execution module 304 may edit tick information of MIDI file 1000 based on the video.

At 1130, analyzing unit 412 within processing module 302 may synchronize MIDI event with a video frame based on tick information edited at 1120. In some embodiments, recognition unit 411 may identify time information of the video frame. In some embodiments, analyzing unit 412 may match MIDI event(s) with the video frame(s) based on the tick information of MIDI file 1000 and time information of the video frame. For example, the processing module may exam the tick information of the MIDI file 1000 and the tick information of the video frame, and match the tick information of the MIDI file 1000 and video frame, so that when the video and the MIDI file are operated by the instrument system independently and simultaneously, the music corresponding to the MIDI file 1000 and the video may be played synchronously. When the tick information of the MIDI file 1000 and the tick information of the video do not match, simultaneously playing the MIDI file 1000 and the video according to their corresponding tick information may result in mismatch between the music and the video. Accordingly, the processing module 302 may edit the tick information of the MIDI file to make it match the tick information of the video. To this end, the processing module 302 may obtain the tick information of a video frame and determine a value thereof, then find the corresponding tick information of the MIDI file 1000 (i.e., where the music and the video should have been played at the same time) and assign the tick value of the video frame to the corresponding tick value of the MIDI file. This may result the music corresponding to the MIDI file to be played faster or slower, so that when the video and the MIDI file are operated by the system simultaneously, the music corresponding to the MIDI file 1000 and the video may be played synchronously. When the system is connected with a real instrument, such as piano, the MIDI file may be played on the instrument instead of on an electronic device such as a music player.

At 1140, detection module 307 may detect MIDI event corresponding to the video frame. In some embodiments, detection module 307 may detect MIDI event based on the synchronized MIDI event(s) at 1130. In some embodiments, the video frame may refer to a video frame of the video currently playing in a display of musical instrument 101*a*-101*n*. In some embodiments, detection module 307 may execute a background thread. The background thread may detect MIDI event without interfering the play of the video. In some embodiments, the background thread may detect MIDI event based on tick information converted from the timing information of video frame. For example, the background thread may detect MIDI event within a few milliseconds.

At 1150, execution module 304 may play MIDI event detected at 1140. In some embodiments, MIDI event may include on/off state of MIDI tone. For example, execution module 304 may play MIDI tone corresponding to the video frame in a video on a musical instrument. In some embodiments, a video frame may include a musical instrument performance. For example, execution module 304 may play MIDI tone corresponding to keyboard pressing of the video frame. In some embodiments, processing module 302 may transmit the MIDI event to musical instrument 101*a*-101*n*, and musical instrument 101*a*-101*n* may perform the corresponding musical tone.

Figure 12:
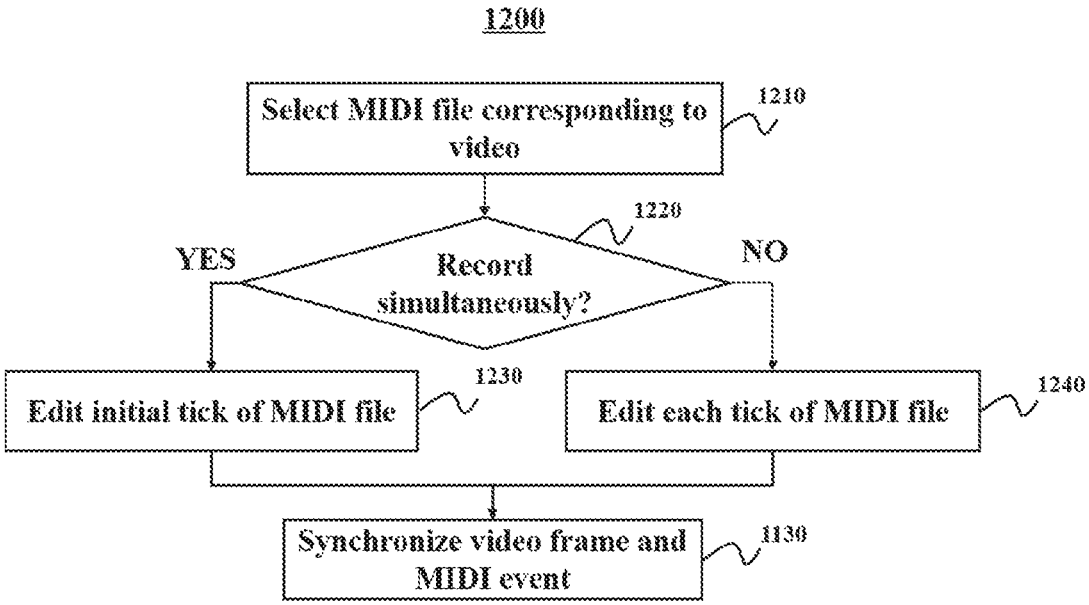
FIG. 12 is a flowchart illustrating an exemplary process for editing MIDI files according to some embodiments of the present disclosure.

FIG. 12 is a flowchart illustrating an exemplary process for editing MIDI file according to some embodiments of the present disclosure. In some embodiments, at 1210, detection module 307 may select MIDI file 1000 corresponding to video from the information acquired at 1110. In some embodiments, the MIDI file may include a MIDI tone corresponding to the musical instrument performance in the video. In some embodiments, the MIDI tone may be decorated with background music. In some embodiments, background music may include various musical instrument performance, e.g., for example, a piano music, orchestral music, a string music, a wind music, and a drum music.

At 1220, recognition unit 411 within processing module 302 may determine whether MIDI file 1000 and video are recorded simultaneously or not. If recognition unit 411 determines MIDI file 1000 and video are recorded simultaneously, processing module 302 may give instruction(s) to Execution module 304 to edit the initial tick of MIDI file 1000 at 1230. If recognition unit 411 determines MIDI file 1000 and the video are not recorded simultaneously, processing module 302 may give instruction(s) to execution module 304 to edit each tick of MIDI file at 1240. In some embodiments, tick(s) of MIDI file 1000 may correspond to timing information of video. In some embodiments, execution module 304 may edit tick(s) of MIDI file 1000 corresponding to timing information of video in order to synchronize MIDI file 1000 with video.

It should be noted that the above description of the process 1200 is merely provided for the purpose of illustration, and not intended to limit the scope of the present disclosure. For persons having ordinary skills in the art, various variations and modification may be conducted in the light of the present disclosure. For example, step 1220 may be skipped. In some embodiments, execution module 304 may edit tick(s) of MIDI file 1000 directly based on timing information of video. However, the variations or modifications do not depart from the scope of the present disclosure.

Figure 13:
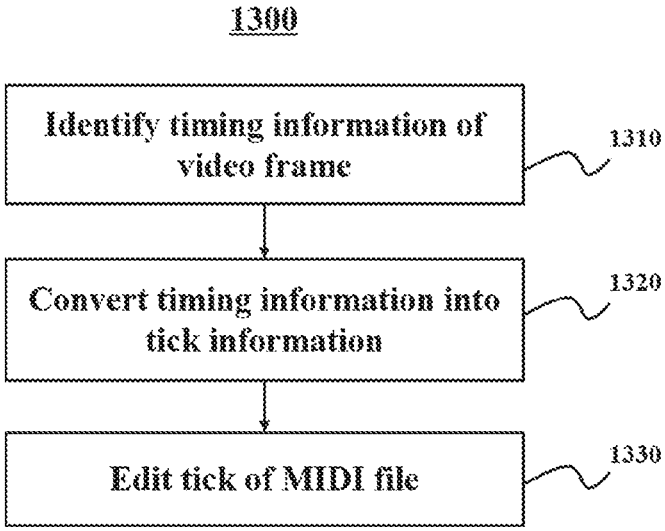
FIG. 13 is a flowchart illustrating an exemplary process for editing tick(s) of MIDI file according to some embodiments of the present disclosure.

FIG. 13 is a flowchart illustrating an exemplary process for editing tick(s) of MIDI file 1000 according to some embodiments of the present disclosure. In some embodiments, at 1310, detection module 307 may identify timing information of video frame(s) in the video. In some embodiments, each video frame may correspond to the timing information. The timing information may be used to match MIDI file 1000 with video.

At 1320, conversion unit 415 may convert timing information identified at 1310 into tick information. In some embodiments, conversion unit 415 may convert timing information based on one or more mathematical models. In some embodiments, MIDI file 1000 may include tick information used to match with timing information of video.

At 1330, processing module 302 may give instruction(s) to Execution module 304 to edit tick(s) of MIDI file 1000 based on tick information converted at 1320.

Figure 14:
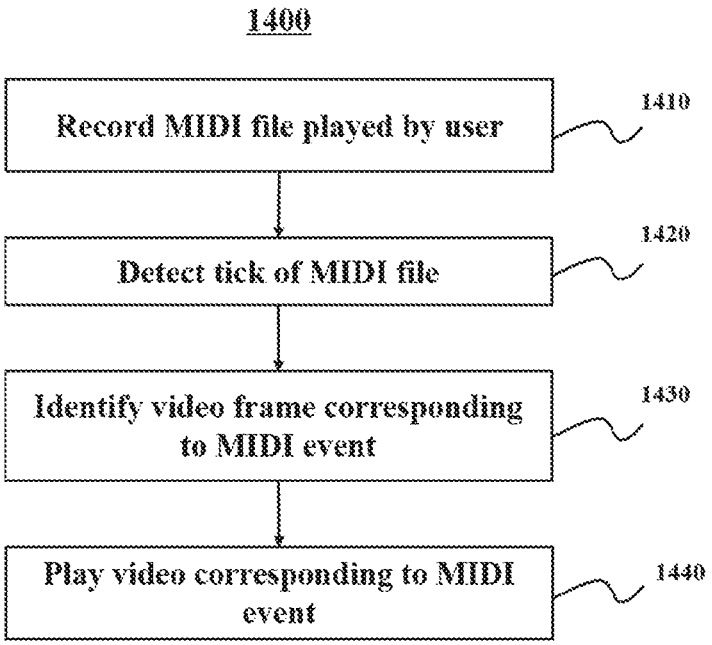
FIG. 14 is a flowchart illustrating an exemplary process for synchronizing video with MIDI files according to some embodiments of the present disclosure.

FIG. 14 is a flowchart illustrating an exemplary process for performing karaoke function according to some embodiments of the present disclosure. The karaoke function may be implemented by system 100 according to process 1400. At 1410, acquisition module 310 may record a MIDI file played by the user. In some embodiments, the user may sing while playing musical instrument 101*a*-101*n*. For example, the user may sing and/or play piano in a low speed, a normal speed, a fast speed, or the like, or any combination thereof. In some embodiments, the display device may display lyrics corresponding to the playing and/or singing of the user.

At 1420, detection module 307 may detect tick(s) of the MIDI file recorded at 1410.

In some embodiments, the MIDI file may include MIDI tone. In some embodiments, conversion unit 415 within processing module 302 may convert tick information of the MIDI file into timing information. For example, conversion unit 415 may convert tick information of the MIDI file based on one or more mathematical model(s).

At 1430, recognition unit 411 within processing module 302 may identify video frame(s) corresponding to MIDI event of the MIDI file recorded at 1410. In some embodiments, recognition unit 411 may identify video frame(s) based on the timing information converted from tick information at 1420. For example, one or more video frame(s) may be synchronized with MIDI event(s) based on the timing information. In some embodiments, the video frame(s) may include lyrics. Lyrics may be displayed at a speed matching the MIDI event(s).

At 1440, the display device may display a video corresponding to MIDI event. In some embodiments, the video may be detected by a background thread performed by processing module 302. In some embodiments, the video may detect based on the timing information converted from tick information at 1420. For example, the video matching the MIDI event(s) may be displayed. Specifically, lyrics may be displayed synchronizing with user singing and playing during karaoke function.

Figure 15:
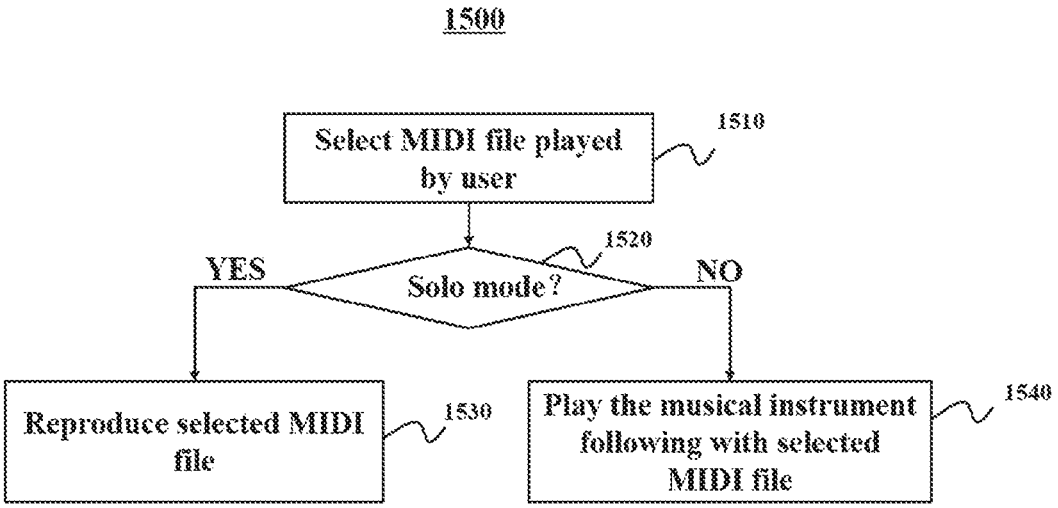
FIG. 15 is a flowchart illustrating an exemplary process for reproducing instrumental performance according to some embodiments of the present disclosure.

FIG. 15 is a flowchart illustrating an exemplary process for reproduction of instrumental performance, remote in distance or time, according to some embodiments of the present disclosure. At 1510, a MIDI file played by a user may be selected. In some embodiments, MIDI file may be edited directly. In some embodiments, MIDI file(s) may be played by various users, such as a musician, a pianist, a music star, a celebrity, a musical educator, a piano professor, or the like, or any combination thereof. For example, a piano hobbyist may select a MIDI file played by a pianist.

At 1520, recognition unit 411 within processing module 302 may determine whether to play musical instrument 101*a*-101*n* in a solo mode or not. If recognition unit 411 determines to play in a solo mode, execution module 304 may reproduce selected MIDI file at 1530. For example, the piano may be played in an automotive mode to reproduce selected MIDI file without user participation. If recognition unit 411 determines to play in a non-solo mode, execution module 304 may reproduce selected MIDI file along with user playing at 1540. For example, the piano may be played in a semi-automotive mode to reproduce selected MIDI file with user playing.

It should be noted that the above steps of the flow diagrams of FIGS. 6-9 and 12-15 can be executed or performed in any order or sequence not limited to the order and sequence shown and described in the figures. Also, some of the above steps of the flow diagrams of FIGS. 6-9 and 12-15 can be executed or performed substantially simultaneously where appropriate or in parallel to reduce latency and processing times. Furthermore, it should be noted that FIGS. 6-9 and 12-15 are provided as examples only. At least some of the steps shown in these figures can be performed in a different order than represented, performed concurrently, or altogether omitted.

It should be borne in mind, however, that all of these and similar terms are to be associated with the appropriate physical quantities and are merely convenient labels applied to these quantities. Unless specifically stated otherwise, as apparent from the following discussion, it is appreciated that throughout the description, discussions utilizing terms such as "sending," "receiving," "generating," "providing," "calculating," "executing," "storing," "producing," "determining," "obtaining," "calibrating," "recording," "acquiring," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The terms "first," "second," "third," "fourth," etc. as used herein are meant as labels to distinguish among different elements and may not necessarily have an ordinal meaning according to their numerical designation.

In some implementations, any suitable computer readable media can be used for storing instructions for performing the processes described herein. For example, in some implementations, computer readable media can be transitory or non-transitory. For example, non-transitory computer readable media can include media such as magnetic media (such as hard disks, floppy disks, etc.), optical media (such as compact discs, digital video discs, Blu-ray discs, etc.), semiconductor media (such as flash memory, electrically programmable read-only memory (EPROM), electrically erasable programmable read-only memory (EEPROM), etc.), any suitable media that is not fleeting or devoid of any semblance of permanence during transmission, and/or any suitable tangible media. As another example, transitory computer readable media can include signals on networks, in connectors, conductors, optical fibers, circuits, any suitable media that is fleeting and devoid of any semblance of permanence during transmission, and/or any suitable intangible media.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented hardware entirely, entirely software (including firmware, resident software, micro-code, etc.) or combining software and hardware implementation that may all generally be referred to herein as a "block", "module," "engine," "unit," "component," or "system". Furthermore, aspects of the present disclosure may take the form of a computer program product embodied in one or more computer readable media having computer readable program code embodied thereon.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various inventive embodiments. This method of disclosure, however, is not to be interpreted as reflecting an intention that the claimed subject matter requires more features than are expressly recited in each claim. Rather, inventive embodiments lie in less than all features of a single foregoing disclosed embodiment.

What is claimed is:

1. A system for musical performance, comprising:

a processing device to:

receive information related to a first performance of a piece of music on a first musical instrument, wherein the first musical instrument serves as a master instrument and is a keyboard instrument, the information including motion information about at least one component of the first musical instrument during the first performance, media content related to the first performance, and musical data related to the piece of music on a first musical instrument;

analyze the received information to associate the motion information with at least one corresponding proportion of the music data and the media content;

generate at least one control signal based on the analysis of the received information;

produce a second performance based on the control signal by causing at least one tone generating device of at least one second musical instrument as at least one slave instrument to perform the piece of music based on the control signal, the at least one second musical instrument including at least one of a wind instrument, a string instrument, or a percussion instrument, wherein the piece of music is performed cooperatively by the master instrument and the at least one slave instrument, and wherein the first performance corresponds to a first portion of the piece of music, the second performance corresponds to a second portion of the piece of music, and the first portion and the second portion are different; and cause the media content related to the first performance to be presented in synchronization with the second performance, wherein the media content includes video content and audio content relating to the first performance acquired using at least one of a camera, a camcorder, or a microphone.

2. The system of claim 1, wherein the at least one second musical instrument further includes a piano, and wherein the at least one tone generating device comprises an actuator.

3. The system of claim 2, wherein to produce the second performance, the processing device is further to actuate a plurality of keys of the piano based on the control signal.

4. The system of claim 1, wherein the media content includes at least one of recorded video content, recorded audio content, a graph, text, or an image related to the first performance.

5. The system of claim 1, wherein to produce the second performance, the processing device is to:

generate the control signal based on the motion information; and cause the tone generating device to perform the piece of music based on the motion information.

6. The system of claim 5, wherein the first musical instrument is a piano, and wherein the motion information comprises information about motions of a plurality of keys of the first musical instrument during the first performance.

7. The system of claim 6, wherein the performance information comprises at least one of an operation sequence of the plurality of keys, timing information about depression of at least one of the plurality of keys, positional information about the plurality of keys, or a musical note produced by at least one of the plurality of keys.

8. The system of claim 1, wherein the performance information is received via a Bluetooth™ link.

9. A system for musical performance, comprising:

a processing device to:

obtain motion information about at least one component of a first musical instrument during a first performance of a piece of music, wherein the first musical instrument serves as a master instrument and is a keyboard instrument;

obtain media content about the first performance and musical data related to the piece of music on a first musical instrument;

analyze the obtained information to associate the motion information with at least one corresponding proportion of the music data and the media content;

generate performance information about the first performance based on the analysis of the received information;

transmit the performance information to at least one second musical instrument, wherein the at least one second musical instrument serves as at least one slave instrument;

generate at least one control signal based on the performance information;

produce a second performance based on the control signal by causing at least one tone generating device of the at least one second musical instrument to perform the piece of music based on the control signal, the at least one second musical instrument including at least one of a wind instrument, a string instrument, or a percussion instrument, wherein the piece of music is performed cooperatively by the master instrument and the at least one slave instrument, and wherein the first performance corresponds to a first portion of the piece of music, the second performance corresponds to a second portion of the piece of music, and the first portion and the second portion are different; and cause the media content related to the first performance to be presented in synchronization with a second performance on the at least one second musical instrument, wherein the media content includes video content and audio content relating to the first performance acquired using at least one of a camera, a camcorder, or a microphone.

10. The system of claim 9, wherein the processing device is further to transmit the performance information to the at least one second musical instrument.

11. The system of claim 9, wherein the first musical instrument is a piano, and wherein the motion information comprises at least one of an operation sequence of a plurality of keys of the first musical instrument, timing information about depression of the plurality of keys, positional information about the plurality of keys, or a musical note produced by at least one of the plurality of keys.

12. The system of claim 11, further comprising at least one sensor configured to obtain the motion information.

13. The system of claim 9, wherein the performance information is transmitted via a Bluetooth™ link.

14. A method for musical performance, comprising:

receiving information related to a first performance of a piece of music on a first musical instrument, wherein the first musical instrument serves as a master instrument and is a keyboard instrument, the information including motion information about at least one component of the first musical instrument during the first performance, media content related to the first performance, and musical data related to the piece of music on a first musical instrument;

analyze the received information to associate the motion information with at least one corresponding proportion of the music data and the media content;

generating at least one control signal based on the analysis of the received information; and producing, by a processing device, a second performance based on the control signal, wherein producing the second performance further comprises:

controlling at least one tone generating device of at least one second musical instrument as at least one slave instrument to perform the piece of music based on the control signal, the at least one second musical instrument including at least one of a wind instrument, a string instrument, or a percussion instrument, wherein the piece of music is performed cooperatively by the master instrument and the at least one slave instrument, and wherein the first performance corresponds to a first portion of the piece of music, the second performance corresponds to a second portion of the piece of music, and the first portion and the second portion are different; and causing media content related to the first performance to be presented in synchronization with the second performance, wherein the media content includes video content and audio content relating to the first performance acquired using at least one of camera, camcorder or microphone.

15. The method of claim 14, wherein the performance information is received via a Bluetooth™ link.

16. The method of claim 14, wherein producing the second performance further comprises:

generating the control signal based on the motion information; and causing the at least one tone generating device to perform the music based on the motion information.

17. The method of claim 14, wherein the at least one second musical instrument further includes a piano, and wherein the at least one tone generating device comprises an actuator.

18. The method of claim 17, wherein producing the second performance further comprises:

actuating a plurality of keys of the piano based on the control signal.

* * * * *